US006794641B2

(12) United States Patent
Bateman et al.

(10) Patent No.: US 6,794,641 B2
(45) Date of Patent: Sep. 21, 2004

(54) MASS SPECTROMETER

(75) Inventors: Robert Harold Bateman, Knutsford (GB); Kevin Giles, Altrincham (GB); Steve Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/448,059

(22) Filed: May 30, 2003

(65) Prior Publication Data

US 2004/0026613 A1 Feb. 12, 2004

Related U.S. Application Data

(60) Provisional application No. 60/421,764, filed on Oct. 29, 2002.

(30) Foreign Application Priority Data

May 30, 2002 (GB) ..... 0212508
Apr. 11, 2003 (GB) ..... 0308417

(51) Int. Cl.[7] ..... H01J 49/40

(52) U.S. Cl. ..... 250/281; 250/287; 250/286; 250/282; 250/290; 250/292

(58) Field of Search ..... 250/287, 281, 250/286, 282, 290, 292

(56) References Cited

U.S. PATENT DOCUMENTS

| | | | | |
|---|---|---|---|---|
| 5,206,506 A | | 4/1993 | Kirchner | |
| 5,572,035 A | | 11/1996 | Franzen | |
| 5,811,800 A | | 9/1998 | Franzen et al. | |
| 5,847,386 A | | 12/1998 | Thomson et al. | |
| 5,905,258 A | | 5/1999 | Clemmer et al. | |
| 6,020,586 A | * | 2/2000 | Dresch et al. | 250/287 |
| 6,107,628 A | | 8/2000 | Smith et al. | |
| 6,403,953 B2 | | 6/2002 | Whitehouse et al. | |
| 6,417,511 B1 | | 7/2002 | Russ, IV et al. | |
| 6,489,610 B1 | | 12/2002 | Barofsky et al. | |
| 6,545,268 B1 | | 4/2003 | Verentchikov et al. | |
| 6,559,444 B2 | | 5/2003 | Franzen | |
| 6,693,276 B2 | | 2/2004 | Weiss et al. | |
| 2001/0032939 A1 | | 10/2001 | Fuhrer et al. | |

(List continued on next page.)

FOREIGN PATENT DOCUMENTS

| | | |
|---|---|---|
| CA | 2281405 | 3/2000 |
| JP | 11-307040 | 11/1999 |
| JP | 2000-113852 | 4/2000 |
| JP | 2000-123780 | 4/2000 |
| WO | WO 94/01883 | 1/1994 |
| WO | WO 97/49111 | 12/1997 |
| WO | WO 02/43105 | 5/2002 |

OTHER PUBLICATIONS

C N Booth, "Nuclear and Paricle Detectors", http://www-.shef.ac.uk/physics/teaching/phy311/semiconductor.html, Mar. 14, 2002.*

(List continued on next page.)

*Primary Examiner*—Nikita Wells
*Assistant Examiner*—James J. Leybourne
(74) *Attorney, Agent, or Firm*—Diederiks & Whitelaw, PLC

(57) ABSTRACT

A mass spectrometer is disclosed wherein ions from a pulsed ion source are dispersed in a drift region so that the ions become separated according to their mass to charge ratios. The ions are then received by an ion guide in which multiple trapping regions are created and wherein the multiple trapping regions are translated along the length of the ion guide. The ion guide receives the ions so that all the ions trapped in a particular trapping region have substantially the same or similar mass to charge ratios. The ions are released from the exit of the ion guide and the pusher/puller electrode of an orthogonal acceleration Time of Flight mass analyzer is arranged to be energised in synchronization with the ions emerging from the ion guide. The trapping regions may be translated along the ion guide with a velocity which becomes progressively slower and the delay time of the pusher/puller electrode may be progressively increased.

102 Claims, 4 Drawing Sheets

U.S. PATENT DOCUMENTS

| | | | | |
|---|---|---|---|---|
| 2002/0063207 | A1 | 5/2002 | Bateman et al. | |
| 2002/0063209 | A1 | 5/2002 | Bateman et al. | |
| 2002/0063210 | A1 | 5/2002 | Bateman et al. | |
| 2002/0070338 | A1 | 6/2002 | Loboda | |
| 2002/0070388 | A1 * | 6/2002 | Greenberg et al. | 257/122 |
| 2002/0079443 | A1 | 6/2002 | Krutchinsky et al. | |
| 2002/0113207 | A1 | 8/2002 | Lee et al. | |
| 2002/0148959 | A1 | 10/2002 | Weiss et al. | |

OTHER PUBLICATIONS

Teloy et al., "Integral Cross Sections for Ion–Molecule Reactions. 1. The Guided Beam Technique", Chemical Physics 4, pp. 417–427, 1974.

Gerlich et al., "Ion Trap Studies of Association Processes in Collisions of $CH_{3^+}$ and $CD_{3^+}$ With n–$H_2$,p–$H_2$, $D_2$ and He at 80 K", The Astrophysical Journal, vol. 347, pp. 849–854, 1989.

Guan et al., "Stacked–Ring Electrostatic Ion Guide", Journal American Society for Mass Spectrometry, vol. 7, pp. 101–106.

Franzen et al., "Electrical Ion Guides", ASMS Book of Abstracts, pp. 1170, 1996.

Shaffer et al., "A Novel Ion Funnel for Ion Focusing at Elevated Pressures", ASMS Book of Abstracts, pp. 375, 1997.

Shaffer et al., "A Novel Ion Funnel for Focusing Ions at Elevated Pressure Using Electrospray Ionization Mass Spectrometry". Rapid Communications in Mass Spectrometry, vol. 11, pp. 1813–1817, 1997.

Shaffer et al., "An Ion Funnel Interface for Improved Ion Focusing and Sensitivity Using Electrospray Ionization Mass Spectrometry", Analytical Chemistry, vol. 70, No. 19, pp. 4111–4119, 1998.

Shaffer et al., "Characterization of an Improved Electrodynamic Ion Funnel Interface for Electrospray Ionization Mass Spectrometry", Analytical Chemistry, vol. 71, No. 15, pp. 2957–2964, 1999.

Tolmachev et al., "Charge Capacity Limitations of Radio Frequency Ion Guides in Their Use for Improved Ion Accumulation and Trapping in Mass Spectrometry", Analytical Chemistry, vol. 72, No. 5, pp. 970–978, 2000.

Kim et al., "Design and Implementation of a New Electrodynamic Ion Funnel", Analytical Chemistry, vol. 72, No. 10, pp. 2247–2255, 2000.

Luca et al., "On the Combination of a Linear Field Free Trap With a Time–Of–Flight Mass Spectrometer", Review of Scientific Instruments, vol. 72, No. 7, pp. 2900–2908, 2001.

Bateman et al., "Evaluation of a Stacked–Ring Radio Frequency Ion Transmission Device at Intermediate Pressures", ASMS, 2001.

Gerlich, "Inhomogeneous RF Fields: A Versatile Tool For the Study of Processes With Slow Ions", Advances in Chemical Physics Series, vol. 82, Chapter 1, pp. 1–176, 1992.

Gerlich, "Rf Ion Guides", Encyclopedia of Mass Spectrometry, vol. 5, pp. 1–34, 2003.

Masuda et al., "Separation of Small Particles Suspended in Liquid by Nonuniform Traveling Field", IEEE Transactions on Industry Applications, vol. 1A–23, No. 3, pp. 474–480, 1987.

Masuda et al., "Characteristics of Standing–Wave, Ring-Type Electric Curtain. Experimental Study", Electrical Engineering in Japan, vol. 93, No. 1, pp. 78–83, 1973.

Masuda et al., "Approximation for Calculating Nonuniform Traveling Fields", Electrical Engineering in Japan, vol. 96, No. 5, pp. 25–31, 1976.

Masuda et al., "Approximate or Calculating a Non–Uniform Traveling Field", Journal of Electrostatics, pp. 351–370, 1975.

Hu et al., "Design of Traveling–Wave Field Panel for Pharmaceutical Powders Based on Computer Simulation of Particle Trajectories", IEEE Transactions on Industry Applications, vol. 33, No. 3, pp. 641–650, 1997.

* cited by examiner

MASS SPECTROMETER

CROSS-REFERENCE TO RELATED APPLICATIONS

This application claims the benefit of the filing of U.S. Provisional Patent Application Serial No. 60/421,764 filed Oct. 29, 2002.

BACKGROUND OF THE INVENTION

1. Field of the Invention

The present invention relates to a mass spectrometer and a method of mass spectrometry.

2. Discussion of the Prior Art

The present invention relates to a mass spectrometer and to a method of mass spectrometry.

Radio Frequency (RF) ion guides are commonly used for confining and transporting ions and comprise an arrangement of electrodes wherein an RF voltage is applied between neighbouring electrodes so that a pseudo-potential well or valley is provided. The pseudo-potential well can be arranged to confine ions and may be used to transport ions by acting as an ion guide. Its use as an ion guide is well known and can be very efficient.

Known RF ion guides can still function efficiently as an ion guide even at relatively high pressures where ions are likely to undergo frequent collisions with residual gas molecules. The collisions with gas molecules may cause ions to scatter and lose energy but the pseudo-potential well generated by the RF ion guide acts to radially confine the ions within the ion guide. In this respect the known RF ion guide has an advantage over guide wire types of ion guides where a DC voltage is applied to a central wire running down the centre of a conducting tube and wherein ions are held in orbit around the central guide wire. If ions undergo many collisions with gas molecules in a guide wire type of ion guide then they will lose energy and will eventually collapse into the central guide wire and be lost.

It is desired to provide an improved ion guide for a mass spectrometer and an improved method of mass spectrometry.

SUMMARY OF THE INVENTION

According to an aspect of the present invention there is provided a mass spectrometer comprising:

a device for temporally or spatially dispersing a group of ions according to a physico-chemical property;

an ion guide comprising a plurality of electrodes, the ion guide receiving in use at least some of the ions which have become dispersed according to the physico-chemical property;

wherein multiple trapping regions are generated or created along at least a portion of the length of the ion guide wherein at least a first group of ions having a physico-chemical property within a first range are trapped within a first trapping region and a second group of ions having a physico-chemical property within a second different range are trapped within a second different trapping region and wherein the multiple trapping regions are translated along at least a portion of the length of the ion guide.

According to the preferred embodiment at least a majority of ions trapped within the first trapping region and/or at least a majority of ions trapped within the second trapping region have substantially the same or similar the physico-chemical property. For example, at least 50%, 60%, 70%, 80%, 90% or 95% of ions in a particular trapping region may have substantially the same or similar physico-chemical property.

The physico-chemical property is preferably mass to charge ratio. Ions may be separated according to their mass to charge ratio by providing a field free region arranged upstream of the ion guide wherein ions which have been accelerated to have substantially the same kinetic energy become dispersed according to their mass to charge ratio. The field free region may be provided within an ion guide selected from the group consisting of: (i) a quadrupole rod set; (ii) a hexapole rod set; (iii) an octopole or higher order rod set; (iv) an ion tunnel ion guide comprising a plurality of electrodes having apertures through which ions are transmitted, the apertures being substantially the same size; (v) an ion funnel ion guide comprising a plurality of electrodes having apertures through which ions are transmitted, the apertures becoming progressively smaller or larger; and (vi) a segmented rod set.

According to the preferred embodiment a pulsed ion source is provided wherein in use a packet or ions emitted by the pulsed ion source enters the field free region. According to another embodiment an ion trap may be arranged upstream of the field free region wherein in use the ion trap releases a packet of ions which enters the field free region.

According to a less preferred embodiment the physico-chemical property may be ion mobility. According to this embodiment a drift region may be arranged upstream of the ion trap wherein ions become dispersed according to their ion mobility. In such an embodiment the drift region preferably has a constant axial electric field or a time varying axial electric field. The drift region may be provided within an ion guide selected from the group consisting of: (i) a quadrupole rod set; (ii) a hexapole rod set; (iii) an octopole or higher order rod set; (iv) an ion tunnel ion guide comprising a plurality of electrodes having apertures through which ions are transmitted, the apertures being substantially the same size; (v) an ion funnel ion guide comprising a plurality of electrodes having apertures through which ions are transmitted, the apertures becoming progressively smaller or larger; and (vi) a segmented rod set.

A pulsed ion source may be provided wherein in use a packet of ions emitted by the pulsed ion source enters the drift region. An ion trap may be arranged upstream of the drift region wherein in use the ion trap releases a packet of ions which enters the drift region.

According to another aspect of the present invention there is provided a mass spectrometer comprising:

a mass to charge ratio selective ion trap which releases in use at least a first group of ions having mass to charge ratios within a first range and then at least a second group of ions having mass to charge ratios within a second range;

an ion guide comprising a plurality of electrodes arranged to receive at least some of the first group of ions and at least some of the second group of ions;

wherein multiple trapping regions are generated or created along at least a portion of the length of the ion guide wherein at least some of the ions of the first group are trapped within a first trapping region and at least some of the ions of the second group are trapped within a second different trapping region; and wherein the multiple trapping regions are translated along at least a portion of the length of the ion guide.

The mass to charge ratio selective ion trap may comprise a 2D (linear) quadrupole ion trap, a 3D (Paul) quadrupole ion trap or a Penning ion trap.

Preferably, at least a majority of the ions trapped within the first trapping region have substantially the same mass to charge ratio and/or at least a majority of the ions trapped within the second trapping region have substantially the same mass to charge ratio.

Preferably, at least a majority of the ions trapped within the first trapping region have mass to charge ratios which differ by less than x mass to charge ratio units and/or at least a majority of the ions trapped within the second trapping region have mass to charge ratios which differ by less than x mass to charge ratio units, wherein x is selected from the group consisting of: (i) 500; (ii) 450; (iii) 400; (iv) 350; (v) 300; (vi) 250; (vii) 200; (viii) 150; (ix) 100; (x) 90; (xi) 80; (xii) 70; (xiii) 60; (xiv) 50; (xv) 40; (xvi) 30; (xvii) 20; (xviii) 10; and (xix) 5.

At least a majority of the ions trapped within the first trapping region and/or at least a majority of the ions trapped within the second trapping region may have mass to charge ratios which differ by less than: (i) 30%; (ii) 25%; (iii) 20%; (iv) 15%; (v) 10%; (vi) 5%; (vii) 4%; (viii) 3%; (ix) 2%; or (x) 1%.

According to the preferred embodiment one or more transient DC voltages or one or more transient DC voltage waveforms are progressively applied to the electrodes so that ions are urged along the ion guide.

An axial voltage gradient may be maintained along at least a portion of the length of the ion guide and the axial voltage gradient preferably varies with time whilst ions are being transmitted through the ion guide.

The ion guide preferably comprises a first electrode held at a first reference potential, a second electrode held at a second reference potential, and a third electrode held at a third reference potential, wherein:

at a first time $t_1$ a first DC voltage is supplied to the first electrode so that the first electrode is held at a first potential above or below the first reference potential;

at a second later time $t_2$ a second DC voltage is supplied to the second electrode so that the second electrode is held at a second potential above or below the second reference potential; and at a third later time $t_3$ a third DC voltage is supplied to the third electrode so that the third electrode is held at a third potential above or below the third reference potential.

According to one embodiment, at the first time $t_1$ the second electrode is at the second reference potential and the third electrode is at the third reference potential;

at the second time $t_2$ the first electrode is at the first potential and the third electrode is at the third reference potential; and at the third time $t_3$ the first electrode is at the first potential and the second electrode is at the second potential.

According to another embodiment at the first time $t_1$ the second electrode is at the second reference potential and the third electrode is at the third reference potential;

at the second time $t_2$ the first electrode is no longer supplied with the first DC voltage so that the first electrode is returned to the first reference potential and the third electrode is at the third reference potential; and at the third time $t_3$ the first electrode is at the first reference potential and the second electrode is no longer supplied with the second DC voltage so that the second electrode is returned to the second reference potential.

Preferably, the first, second and third reference potentials are substantially the same. The first, second and third DC voltages are also preferably substantially the same. Preferably, the first, second and third potentials are substantially the same.

According to an embodiment the ion guide comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential. Preferably, a plurality of segments are maintained at substantially the same DC potential. Preferably, each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

Ions are preferably confined radially within the ion guide by an AC or RF electric field. Ions are preferably radially confined within the ion guide in a pseudo-potential well and are constrained axially by a real potential barrier or well.

The transit time of ions through the ion guide is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

The ion guide and/or the drift region are preferably maintained, in use, at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

The ion guide and/or the drift region are preferably maintained, in use, at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

The ion guide and/or the drift region are preferably maintained, in use, at a pressure selected from the group consisting of: (i) between 0.0001 and 10 mbar; (ii) between 0.001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

The field free region is preferably maintained, in use, at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

The field free region is preferably maintained, in use, at a pressure selected from the group consisting of; (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

The field free region is preferably maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; (xxi) between $5\times10^{-5}$ and $1\times10^{-4}$ mbar.

The ion guide and/or the drift region are preferably maintained, in use, at a pressure such that a viscous drag is imposed upon ions passing through the ion guide and/or the drift region.

According to the preferred embodiment one or more transient DC voltages or one or more transient DC voltage waveforms are initially provided at a first axial position and are then subsequently provided at second, then third different axial positions along the ion guide.

One or more transient DC voltages or one or more transient DC voltage waveforms preferably move in use from one end of the ion guide to another end of the ion guide so that ions are urged along the ion guide.

The one or more transient DC voltages preferably create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms preferably comprise a repeating waveform such as a square wave.

The amplitude of the one or more transient DC voltages or the one or more transient DC voltage waveforms may remain substantially constant with time. Alternatively, the amplitude of the one or more transient DC voltages or the one or more transient DC voltage waveforms may vary with time. The amplitude of the one or more transient DC voltages or the one or more transient DC voltage waveforms may either: (i) increases with time; (ii) increases then decreases with time; (iii) decreases with time; or (iv) decreases then increases with time.

According to an embodiment the ion guide comprises an upstream entrance region, a downstream exit region and an intermediate region, wherein:

- in the entrance region the amplitude of the one or more transient DC voltages or the one or more transient DC voltage waveforms has a first amplitude;
- in the intermediate region the amplitude of the one or more transient DC voltages or the one or more transient DC voltage waveforms has a second amplitude; and
- in the exit region the amplitude of the one or more transient DC voltages or the one or more transient DC voltage waveforms has a third amplitude.

The entrance and/or exit region preferably comprise a proportion of the total axial length of the ion guide selected from the group consisting of: (i)<5%; (ii) 5–10%; (iii) 10–15%; (iv) 15–20%; (v) 20–25%; (vi) 25–30%; (vii) 30–35%; (viii) 35–40%; and (ix) 40–45%.

The first and/or third amplitudes are preferably substantially zero and the second amplitude is preferably substantially non-zero.

The second amplitude is preferably larger than the first amplitude and/or the second amplitude is preferably larger than the third amplitude.

One or more transient DC voltages or one or more transient DC voltage waveforms preferably pass in use along the ion guide with a first velocity. The first velocity preferably: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

The one or more transient DC voltages or the one or more transient DC voltage waveforms preferably cause ions within the ion guide to pass along the ion guide with a second velocity.

The difference between the first velocity and the second velocity is preferably less than or equal to 100 m/s, 90 m/s, 80 m/s, 70 m/s, 60 m/s, 50 m/s, 40 m/s, 30 m/s, 20 m/s, 10 m/s, 5 m/s or 1 m/s.

The first velocity is preferably selected from the group consisting of; (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

The second velocity is preferably selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

According to the preferred embodiment the second velocity is substantially the same as the first velocity.

The one or more transient DC voltages or the one or more transient DC voltage waveforms preferably have a frequency, and wherein the frequency: (i) remains substantially constant; (ii) varies; (iii) increases; (iv) increases then decreases; (v) decreases; or (vi) decreases then increases.

The one or more transient DC voltages or the one or more transient DC voltage waveforms preferably have a wavelength, and wherein the wavelength: (i) remains substantially constant; (ii) varies; (iii) increases; (iv) increases then decreases; (v) decreases; or (vi) decreases then increases.

According to an embodiment two or more transient DC voltages or two or more transient DC voltage waveforms are arranged to move: (i) in the same direction; (ii) in opposite directions; (iii) towards each other; or (iv) away from each other.

The one or more transient DC voltages or the one or more transient DC voltage waveforms are preferably repeatedly generated and passed in use along the ion guide, and wherein the frequency of generating the one or more transient DC voltages or the one or more transient DC voltage waveforms: (i) remains substantially constant; (ii) varies; (iii) increases; (iv) increases then decreases; (v) decreases; or (vi) decreases then increases.

Preferably, the one or more transient DC voltages or the one or more transient DC voltage waveforms has a wavelength which remains substantially the same and a frequency which decreases with time so that the velocity of the one or more transient DC voltages or the one or more transient DC voltages decreases with time.

Pulses of ions preferably emerge from an exit of the ion guide.

The mass spectrometer preferably further comprises an ion detector, the ion detector being arranged to be substantially phase locked in use with the pulses of ions emerging from the exit of the ion guide.

The mass spectrometer preferably further comprises a Time of Flight mass analyser comprising an electrode for injecting ions into a drift region, the electrode being arranged to be energised in use in a substantially synchronised manner with the pulses of ions emerging from the exit of the ion guide.

Preferably, the mass spectrometer further comprises an ion trap arranged downstream of the ion guide, the ion trap being arranged to store and/or release ions from the ion trap in a substantially synchronised manner with the pulses of ions emerging from the exit of the ion guide. The mass spectrometer may also comprise an mass filter arranged downstream of the ion guide, wherein a mass to charge ratio transmission window of the mass filter is varied in a substantially synchronised manner with the pulses of ions emerging from the exit of the ion guide.

The ion guide may comprise an ion funnel comprising a plurality of electrodes having apertures therein through which ions are transmitted, wherein the diameter of the apertures becomes progressively smaller or larger. Alternatively, the ion guide may comprise an ion tunnel comprising a plurality of electrodes having apertures therein through which ions are transmitted, wherein the diameter of the apertures remains substantially constant. The ion guide may comprise a stack of plate, ring or wire loop electrodes.

The ion guide preferably comprises a plurality of electrodes, each electrode having an aperture through which ions are transmitted in use. Each electrode preferably has a substantially circular aperture. Preferably, each electrode has a single aperture through which ions are transmitted in use.

The diameter of the apertures of at least 50%, 60%, 70%, 80%, 90% or 95% of the electrodes forming the ion guide is preferably selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

Preferably, at least 50%, 60%, 70%, 80%, 90% or 95% of the electrodes forming the ion guide have apertures which are substantially the same size or area.

According to a less preferred embodiment the ion guide may comprise a segmented rod set.

The ion guide may consist of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

The thickness of at least 50%, 60%, 70%, 80%, 90% or 95% of the electrodes may be selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

The ion guide preferably has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

Preferably, at least 10%, 20%, 30%, 40%, 50%, 60%, 70%, 80%, 90%, or 95% of the electrodes are connected to both a DC and an AC or RF voltage supply. Preferably, axially adjacent electrodes are supplied with AC or RF voltages having a phase difference of 180°.

The mass spectrometer preferably further comprises an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI") ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

The ion source may comprise a continuous ion source or a pulsed ion source.

According to the preferred embodiment ions exiting the ion guide are arranged to have substantially constant energy substantially independent of their mass to charge ratio.

Preferably, a DC potential waveform is applied to the electrodes and wherein the velocity of the DC potential waveform becomes progressively slower. The ions in a pulse of ions emitted from the ion guide preferably have substantially the same energy or similar energies. Preferably, the ions from a plurality of pulses of ions emitted from the ion guide have substantially the same energy or similar energies.

A mass analyser is preferably provided to mass analyse the ions exiting the ion guide. The ions exiting the ion guide are preferably accelerated through a constant voltage difference prior to mass analysing the ions. The ions are preferably mass analysed by an orthogonal acceleration Time of Flight mass analyser. An electrode of the orthogonal acceleration Time of Flight mass analyser is preferably energised after a delay time after ions are released from the ion guide. The delay time is preferably progressively increased, decreased or varied. The delay time may be increased or decreased substantially linearly, in a regular manner or according to a predetermined manner.

According to another aspect of the present invention there is provided a method of mass spectrometry comprising:

temporally or spatially dispersing a group of ions according to a physico-chemical property;

receiving at least some of the ions which have become dispersed according to the physico-chemical property in an ion guide comprising a plurality of electrodes;

generating or creating multiple trapping regions along at least a portion of the length of the ion guide wherein at least a first group of ions having a physico-chemical property within a first range are trapped within a first trapping region and a second group of ions having a physico-chemical property within a second different range are trapped within a second different trapping region; and translating the multiple trapping regions along at least a portion of the length of the ion guide.

According to another aspect of the present invention there is provided a method of mass spectrometry comprising:

releasing a first group ions having mass to charge ratios within a first range from a mass to charge ratio selective ion trap;

receiving at least some of the ions of the first group in an ion guide comprising a plurality of electrodes;

providing a first trapping region within the ion guide so that at least some of the ions of the first group are trapped within the first trapping region;

releasing a second group ions having mass to charge ratios within a second range from the mass selective ion trap;

receiving at least some of the ions of the second group in the ion guide;

providing a second different trapping region within the ion guide so that at least some of the ions of the second group are trapped within the second trapping region; and translating at least the first and second trapping regions along at least a portion of the length of the ion guide.

According to another aspect of the present invention there is provided a mass spectrometer comprising:

a pulsed ion source for emitting a pulse of ions;

a region wherein ions in a pulse become dispersed according to their mass to charge ratio; and an ion guide comprising a plurality of electrodes, wherein in use a plurality of trapping regions are generated or created along at least a portion of the length of the ion guide and wherein the ion guide is arranged to receive the ions which have become dispersed according to their mass to charge ratio so that at least 50%, 60%, 70%, 80%, 90% or 95% of the ions within a trapping region have substantially the same or similar mass to charge ratios.

Preferably, the plurality of trapping regions are translated along at least a portion of the length of the ion guide with a velocity which becomes progressively slower.

Preferably, bunches of ions emerge in use from the ion guide and the mass spectrometer further comprises an orthogonal acceleration Time of Flight mass analyser comprising an electrode for injecting ions into a drift region, wherein the electrode is energised after a delay period after each bunch of ions is released from a trapping region in the ion guide and wherein the energisation of the electrode is synchronised with the arrival of each bunch of ions at the electrode and wherein the delay period is progressively increased.

According to another aspect of the present invention there is provided a method of mass spectrometry comprising:

emitting a pulse of ions;

arranging for the ions in a pulse to become dispersed according to their mass to charge ratio;

providing an ion guide comprising a plurality of electrodes;

generating or creating a plurality of trapping regions along at least a portion of the length of the ion guide; and receiving within the ion guide the ions which have become dispersed according to their mass to charge ratio so that at least 50%, 60%, 70%, 80%, 90% or 95% of the ions within a trapping region have substantially the same or similar mass to charge ratios.

The method preferably further comprises translating the plurality of trapping regions along at least a portion of the length of the ion guide with a velocity which becomes progressively slower.

Preferably, the method further comprises:

arranging for bunches of ions to emerge from the ion guide;

providing an orthogonal acceleration Time of Flight mass analyser comprising an electrode for injecting ions into a drift region;

energising the electrode after a delay period after each bunch of ions is released from a trapping region in the ion guide and in a synchronised manner with the arrival of each bunch of ions at the electrode; and progressively increasing said delay period.

According to a particularly preferred embodiment a pulse of ions may be emitted from a pulsed ion source or released from an ion trap and then accelerated so that substantially all the ions have substantially the same energy. The ions may then be allowed to pass through a field free drift region which is maintained at a relatively low pressure so that ions of different mass to charge ratios will travel through the drift region with different velocities. Accordingly, ions having a relatively low mass to charge ratio will travel faster than ions having relatively higher mass to charge ratios and hence will reach the end of the drift region before other ions. Ions will therefore become temporally dispersed according to their mass to charge ratio. Similarly, if ions enter a drift region maintained at a relatively high pressure with an axial electric field to urge ions through the drift region then the ions will become temporally dispersed according to their ion mobility.

An advantage of the preferred embodiment is that once ions have been dispersed according to a physico-chemical property such as ion mobility or mass to charge ratio, then ions having substantially the same or similar physico-chemical properties can be trapped and stored within the same trapping region within the ion guide. The trapping regions are then translated along the ion guide so that the next fraction of ions arriving at the ion guide is received within the next trapping region.

The preferred embodiment allows ions having substantially similar properties to be ejected from the ion guide at substantially the same time. This is particularly useful and enables, for example, the delay time of a pusher/puller electrode of a Time of Flight mass analyser downstream of the ion guide to be set so that substantially all the ions released from the ion guide in a packet of ions are then orthogonally accelerated into the drift region of the mass analyser.

According to an embodiment, as groups of ions having larger mass to charge ratios become trapped within separate trapping regions within the ion guide, then the trapping regions towards the exit of the ion guide will contain ions having relatively lower mass to charge ratios whereas the trapping regions towards the entrance of the ion guide will contain ions having relatively higher mass to charge ratios. Each packet of ions released from the exit of the ion guide will therefore have an average mass to charge ratio which is slightly higher than that of a preceding package of ions released from the ion guide.

The preferred embodiment is particularly useful when a discontinuous mass analyser such as a quadrupole ion trap, FTICR mass analyser or Time of Flight mass analyser is used. Discontinuous mass analysers operate by receiving a packet of ions which have been accelerated to a given energy. However, this causes ions with different mass to charge ratios to travel with different velocities to the mass analyser. Accordingly, if the packet of ions being passed to the mass analyser has a wide range of mass to charge ratios then different ions will arrive at the mass analyser at different times. In some circumstances this makes it difficult or even impossible to analyse all the different ions and hence this can result in a relatively low duty cycle and accordingly low sensitivity. For example, if the mass analyser is an orthogonal acceleration Time of Flight mass analyser then only ions in the acceleration region at the time of the acceleration pulse will be accelerated into the Time of Flight analyser and the other ions arriving at the pusher electrode before or after the acceleration pulse will be lost.

A particular advantage of the preferred embodiment is that it can be ensured that only ions with a relatively narrow range of mass to charge ratios exit the ion guide at any given time. This allows the delay time of the orthogonal acceleration pulse to be effectively synchronised with the arrival of those ions at the acceleration region. In this way the sampling duty cycle for these ions can be as high as 100% and hence the sensitivity of the mass spectrometer can be very high.

The next packet of ions to be released from the ion guide will also preferably have a narrow spread of mass to charge ratios. The average mass to charge ratio of the ions in this packet will be slightly higher than the previous packet of ions and hence the delay time of the orthogonal acceleration pulse can be substantially synchronised with the arrival of those ions at the acceleration region.

The separation of ions according to mass to charge ratio before arrival at the preferred ion guide may take place in a field free region and/or in an ion guide. If an ion guide is used then the ion guide is preferably an RF ion guide. However, according to less preferred embodiments other types of ion guides such as guide wire ion guides may be used.

According to a preferred embodiment ions may be generated from a pulsed ion source e.g. a laser ablation or MALDI ion source or alternatively the ions may be released in a pulse from an ion trap. Ions then preferably travel through a field free flight tube to the preferred ion guide which is provided with a plurality of trapping regions which are translated along the length of the ion guide. The trapping regions may be created by applying transient DC voltages to certain electrodes so that potential wells are formed between these electrodes. The transient DC voltages are then progressively applied to subsequent electrodes so that the trapping regions move along the ion guide which may be referred to hereinafter as a "travelling wave ion guide".

The ions once released from the ion guide may then be passed through a second field free flight tube to an orthogonal acceleration Time of Flight mass analyser The field free flight tubes are preferably maintained at relatively low pressures e.g. <0.0001 mbar whereas the ion guide with multiple trapping regions is preferably maintained at an intermediate pressure e.g. between 0.001 and 10 mbar.

In the following the distance in meters from the pulsed ion source or ion trap to the entrance of the travelling wave ion guide is $L_1$, the length of the travelling wave ion guide is $L_2$ and the distance from the exit of the travelling wave ion guide to the centre of an orthogonal acceleration Time of Flight acceleration region is $L_3$. The ions are preferably accelerated through a voltage difference of $V_1$ at the ion source or ion trap so that they have energy $E_1$ of $zeV_1$ electron volts. Accordingly, for ions having a mass m the arrival time $T_1$ (in $\mu$s) of ions at the entrance to the travelling wave ion guide after they have been ejected from the ion source or emitted from an upstream ion trap is given by;

$$T_1 = 72L_1\sqrt{\frac{m}{zeV_1}}$$

The velocity v of these ions will be:

$$v = \frac{L_1}{T_1}$$

The travelling wave ion guide is preferably maintained at a pressure between 0.0001 and 100 mbar, further preferably between 0.001 and 10 mbar. At these pressures the gas density is sufficient to impose a viscous drag on the ions and hence the gas will appear as a viscous medium to the ions and will act to slow the ions.

It is preferably arranged that the velocity $v_{wave}$ of one or more transient DC voltages or one or more transient DC voltage waveforms progressively applied to the electrodes forming the ion guide is equal to the velocity v of the ions as they arrive at the entrance to the travelling wave ion guide Since the velocity of the ions arriving at the entrance to the ion guide is inversely proportional to elapsed time $T_1$ from release of ions from the ion source or ion trap, then the velocity $v_{wave}$ of the travelling wave is preferably arranged to decrease with time in a similar manner.

Since the travelling wave velocity $v_{wave}$ is equal to $\lambda/T$ where $\lambda$ is the wavelength and T is the cycle time of the travelling DC waveform, then it follows that the cycle time T should vary in proportion to the elapsed time $T_1$. In other words, for the travelling wave velocity to always equal the velocity of the ions arriving at the entrance to the preferred ion guide, the wave cycle time T should preferably increase linearly with time.

Since the travelling DC wave velocity $v_{wave}$ preferably continuously slows, it could be considered that the ions might travel on ahead of the travelling DC wave. However, the viscous drag resulting from frequent collisions with gas molecules prevents the ions from building up excessive velocity. Consequently, the ions tend to ride on the travelling DC wave rather than run ahead of the travelling DC wave and execute excessive oscillations within the travelling potential wells.

If, in time $\delta t$, the ions travel distance $\delta l$ within the ion guide:

$$\delta l = v\delta t$$

then if the time at which the ions exit the travelling wave ion guide is $T_2$ then the distance $\Delta L$ travelled within the ion guide is:

$$\Delta L = \int_{T_1}^{T_2} v\,\delta t$$

$$\Delta L = \int_{T_1}^{T_2} \frac{L_1}{t}\delta t$$

$$\Delta L = L_1(\ln(T_2) - \ln(T_1))$$

$$\Delta L = L_1\ln\left(\frac{T_2}{T_1}\right)$$

Since the length of the ion guide is $L_2$ and hence $\Delta L = L_2$ then:

$$L_2 = L_1\ln\left(\frac{T_2}{T_1}\right)$$

$$T_2 = T_1 e^{\left(\frac{L_2}{L_1}\right)}$$

Hence, the velocity of the ions $v_x$ as they exit the travelling wave ion guide is equal to that of the travelling DC wave at the time of exit and therefore is:

$$v_x = \frac{L_1}{T_2}$$

$$v_x = \frac{L_1}{T_1} e^{-\left(\frac{L_2}{L_1}\right)}$$

-continued $$v_x = ve^{-\left(\frac{L_2}{L_1}\right)}$$

Since the energy $E_1$ of the ions at the entrance to the ion guide is:

$$E_1 = zeV_1$$

then since:

$$E = \frac{1}{2}mv^2$$

if the energy of the ions at the exit of the travelling wave ion guide is $E_2$ then:

$$E_2 = \frac{1}{2}mv_x^2$$

$$E_2 = \frac{1}{2}mv^2e^{-2\left(\frac{L_2}{L_1}\right)}$$

$$E_2 = E_1e^{-2\left(\frac{L_2}{L_1}\right)}$$

Hence, the energy $E_2$ of the ions as they exit the travelling wave ion guide is a constant fraction equal to exp $(-2(L_2/L_1))$ of the energy $E_1$ they had on entering the ion guide. Hence their energy is independent of their mass to charge ratio. For two reasons this is a particularly favourable outcome.

Firstly, the gas in the travelling wave ion guide will result in frequent ion-molecule collisions which in turn will cause the ions to lose kinetic energy. In the presence of an RF confining field both the axial and radial kinetic energies will be reduced. Furthermore, the axial and radial energies decay approximately exponentially with distance travelled into the ion guide as disclosed in J. Am. Soc. Mass Spectrom., 1998, 9, pp 569–579. From computer simulations it has been estimated that the kinetic energies in the axial and radial directions reduce to 10% whilst passing through a nitrogen gas pressure-distance product of approximately 0.1 mbar-cm. Hence, both the travelling wave velocity and the ion kinetic energies preferably decay exponentially. These two exponential decay rates can be arranged to be approximately the same by appropriate choice of the collision gas molecular mass and pressure. If the travelling wave velocity were set significantly higher than the intrinsic velocity of the ions, then the ions may be caused to fragment which may be undesirable in some modes of operation.

Secondly, it is a characteristic of orthogonal acceleration Time of Flight mass spectrometers that all ions, irrespective of their mass to charge ratio, need to be injected into the orthogonal acceleration region with substantially the same axial energy. Since the ions exiting the travelling wave ion guide will have substantially constant energy independent of their mass to charge ratio then it is only necessary to accelerate the ions through a constant voltage difference $V_3$ after they have left the travelling wave ion guide to give the ions the correct energy $E_3=E_2+zeV_3$ when injected into the orthogonal acceleration region of the orthogonal Time of Flight mass analyser.

As the ions exit the travelling wave ion guide in pulses they will be grouped such that each group contains only ions within a limited range of mass to charge ratios and each group of ions will have ions with an average mass to charge ratio slightly higher than that of a preceding group emitted from the ion guide. Each group of ions after the acceleration stage will have substantially the same energy $E_3$ and therefore their substantially similar transit time to the orthogonal acceleration region of the orthogonal acceleration Time of Flight mass analyser will be proportional to the square root of their average mass. If for each group of ions exiting the travelling wave ion guide the delay time $T_x$ of the pusher electrode of the orthogonal acceleration Time of Flight mass analyser is increased in proportion to the square root of the mass of ions released from the ion guide, then the orthogonal acceleration can be arranged to coincide with the arrival of each group of ions at the orthogonal acceleration region. A very high (approximately 100%) duty cycle can therefore be achieved according to the preferred embodiment.

The time for ions to travel to the exit of the ion guide is $T_2$ which is proportional to $T_1$ which is in turn proportional to the square root of the mass to charge ratio of the ions:

$$T_2 = T_1e^{\left(\frac{L_2}{L_1}\right)}$$

$$T_1 = 72L_1\sqrt{\frac{m}{E_1}}$$

The time for ions to travel from the exit of the travelling wave ion guide to the orthogonal acceleration region is the delay time $T_x$ and is also proportional to the square root of the mass to charge ratio of the ions:

$$T_x = 72L_3\sqrt{\frac{m}{E_3}}$$

Hence the delay time $T_x$ needs to be proportional to $T_1$:

$$T_x = \frac{L_3}{L_1}\sqrt{\frac{E_1}{E_3}}\,T_1$$

In other words, the delay time $T_x$ needs to increase linearly with the time from the original pulse of ions leaving the ion source or ion trap.

As a consequence of the gas present in the travelling wave ion guide and preferably the continuously slowing travelling DC wave velocity, the kinetic energy of the ions will be reduced by a constant factor equal to exp $(-2(L_2/L_1))$ when they emerge from the travelling wave ion guide. If the ions have a substantial energy spread when they enter the travelling wave ion guide then advantageously this will be reduced.

In summary, both the travelling waveform cycle time and the pusher electrode delay time may increase substantially linearly with time starting from the time of the original pulse of ions leaving the pulsed ion source or ion trap. Ions will exit from the travelling wave ion guide with reduced energy and reduced energy spread. The ions exiting the ion guide will also have a substantially constant energy and may be accelerated to higher constant energy with a constant difference in potential. Under such circumstances, ions will arrive at the orthogonal acceleration stage of the orthogonal Time of Flight mass analyser with substantially constant energy and the sampling duty cycle may be as high as 100% for all ions irrespective of their mass.

According to a second main embodiment instead of using a pulsed ion source and a flight tube, a mass to charge ratio selective ion trap such as a 3D ("Paul") or 2D (linear) quadrupole ion trap may be used. The mass to charge ratio selective ion trap is preferably operated in a mass selective ejection mode or resonance ejection mode. For such an ion trap, in which only ions having a relatively narrow range of mass to charge ratios are released from the ion trap, the initial flight tube previously required to separate ions according to their mass to charge ratios is no longer required. Hence, the ion trap may now be positioned in close proximity or directly adjacent to the entrance to the travelling wave ion guide.

The operation of the travelling wave ion guide may be substantially the same as that previously described in relation to the first embodiment. The velocity of the travelling wave may be arranged to be programmed as though the ions of the selected masses had originated from the ion source or ion trap according to the first main embodiment. Hence, the travelling wave ion guide may be arranged to be co-ordinated with the mass to charge ratios of the ions ejected from the ion trap at any particular point in time. Since the travelling DC potential wave is programmed as though the ions originated from a virtual ion source, the programming of the travelling wave ion guide can be selected for any virtual flight tube length $L_1$. This now provides a degree of freedom in the choice of exponential decay of ion energies as they travel through the travelling wave ion guide. This degree of freedom is in addition to that of the gas molecular weight and gas pressure that determines the exponential decay rate of the ion kinetic energies due to ion-molecule collisions. Hence, this arrangement provides greater flexibility when seeking to match these two decay rates.

Any energy spread in the ion beam ejected from the mass to charge ratio selective ion trap may also be reduced as the ions travel through the travelling wave ion guide. The addition of the travelling wave ion guide and flight tube between the ion trap and orthogonal acceleration Time of Flight mass analyser reduce the energy spread of the ions and hence improves the sensitivity and resolution of the Time of Flight mass spectrometer.

The preferred embodiment entails superimposing a repeating pattern of DC electrical potentials along the length of the ion guide so as to form a periodic DC potential waveform ("travelling wave") and causing the waveform to travel or the applied DC potentials to be translated along the ion guide in the direction in which it is required to move the ions and at a velocity at which it is required to move the ions.

The AC or RF ion guide may comprise a multipole rod set or stacked ring set. The ion guide is preferably segmented in the axial direction so that independent transient DC potentials may be applied to each segment and superimposed on top of an AC or RF confining voltage and any constant DC offset voltage. The DC potentials are changed temporally to generate a travelling DC wave in the axial direction.

At any instant in time a voltage gradient is generated between segments to push or pull the ions in a certain direction. As the voltage gradient moves in the required direction so do the ions. The individual DC voltages on each of the segments are preferably programmed to create the desired waveform. The individual DC voltages on each of the segments may also be programmed to change in synchronism such that the waveform (and preferably the wavelength) is maintained but shifted in the direction in which it is desired to move the ions.

The DC potential waveform is preferably superimposed on any nominally imposed axial DC voltage offset. No axial voltage gradient is required although less preferably the travelling DC wave may be provided in conjunction with an axial DC voltage gradient by the application of the travelling waveform superimposed on any axial DC voltage gradient. The transient DC voltage applied to each segment may be above or below that of the constant DC voltage offset to cause movement of the ions in the axial direction or could be a combination of both.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
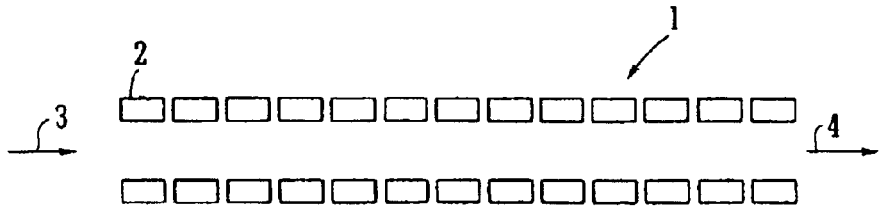
FIG. 1 shows a simplified diagram of a segmented AC or RF ion guide according to the preferred embodiment.
Figure 2:
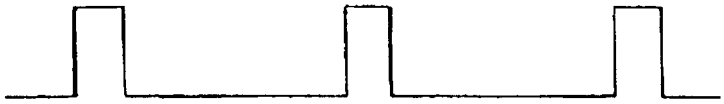
FIG. 2 shows a repeating DC potential waveform which may be applied to an ion guide according to the preferred embodiment.

As shown in FIG. 1 the preferred embodiment relates to an AC or RF ion guide 1 comprising a plurality of electrodes 2. Ions arrive at an entrance 3 to the ion guide 1 and leave the ion guide 1 via an exit 4. The ion guide 1 may comprise a plurality of segments, each segment comprising one or more electrodes 2. The electrodes in a particular segment are preferably maintained at substantially the same DC potential. The DC voltage applied to each segment may be programmed to change continuously or in a series of steps. The sequence of DC voltages applied to each segment may repeat at regular intervals or at intervals which may progressively increase or decrease. The time over which the complete sequence of DC voltages is applied to a particular segment is the cycle time T. The inverse of the cycle time is the travelling DC wave frequency f. The distance along the AC or RF ion guide 1 over which the DC potential waveform repeats itself is the wavelength λ. The wavelength divided by the cycle time is the velocity $v_{wave}$ of the travelling DC wave. Hence, the travelling wave velocity:

$$v_{wave} = \frac{\lambda}{T} = \lambda f$$

According to the preferred embodiment the velocity of the DC potential waveform is arranged to substantially equal that of the velocity of the ions arriving at the ion guide 1. For a given wavelength, the travelling DC wave velocity may be controlled by selection of the cycle time. If the cycle time T progressively increases then the velocity of the DC potential waveform will progressively decrease. The optimum velocity of the travelling DC potential waveform depends on a number of parameters including the mass of the ions and the pressure and composition of the gas in the ion guide 1.

The travelling wave ion guide 1 may be operated at intermediate pressures between 0.0001 and 100 mbar, preferably between 0.001 and 10 mbar, wherein the gas density will be sufficient to impose a viscous drag on the ions. The gas at these pressures will appear as a viscous medium to the ions and will act to slow the ions. The viscous drag resulting from frequent collisions with gas molecules prevents the ions from building up excessive velocity. Consequently, the ions will tend to ride on or with the travelling DC potential waveform rather than run ahead of the DC potential waveform and execute excessive oscillations within the potential wells which are being translated along the length of the ion guide 1.

The presence of a gas in the ion guide 1 imposes a maximum velocity at which the ions will travel through the gas for a given field strength. The higher the gas pressure the more frequent the ion-molecule collisions and the slower the ions will travel for a given field strength. The energy of the ions will be dependent upon their mass and the square of their velocity. If fragmentation is not desired, then the energy of the ions may be kept below about 5–10 eV. This may impose a limit on the velocity of the DC potential waveform. Consequently, the optimum DC potential wave velocity will vary with the mass of the ion, the gas pressure and whether it is desired to transport ions with minimal fragmentation or to fragment ions.

A feature of the preferred ion guide 1 is that the ion guide 1 emits a pulsed beam of ions. The repetition rate of the pulses of ions can be tailored to a mass analyser downstream of the ion guide 1 in terms of scan rates and acquisition times. For example, in a scanning quadrupole system the repetition rate can be made high enough to prevent pulsing across the mass range. In a triple quadrupole tandem mass spectrometer operating in a MRM mode the repetition frequency may be made compatible with the reaction monitoring dwell times. With a quadrupole Time of Flight tandem mass spectrometer, the repetition frequency may be synchronised with the pusher pulses on the Time of Flight mass analyser to maximise ion sampling duty cycle and hence sensitivity. Other embodiments are contemplated wherein the operation of an ion trap and/or a mass filter is substantially synchronised with the pulses of ions emerging from the ion guide.

The pulsed nature of ions exiting the ion guide 1 is a feature of the preferred ion guide 1 irrespective of whether the ion beam entering the ion guide 1 is a continuous beam or a pulsed beam. Accordingly, the ion guide 1 may be used to convert a continuous beam of ions into a pulsed beam of ions. Furthermore, the ion guide 1 may be used to transport a series of ion packets without allowing the ions to become dispersed and merged one with the next. The pulsed nature of ions emitted from the ion guide 1 also allows the detection system to be phase locked with the ion pulses. For example, the detection system response may be modulated or pulsed in the same way the ion beam is modulated or pulsed. This provides a means of improving the signal to noise of the ion detection system since any continuous noise, white noise, or DC offset in the detection system can essentially be eliminated from the detected signal.

Similarly when the travelling wave ion guide 1 is interfaced with a discontinuous mass analyser, the pulsing of an orthogonal acceleration Time of Flight mass spectrometer can be synchronised with the frequency of the DC potential waveform to maximise the duty cycle for ions of a particular range of mass to charge ratios. The range of masses for which the duty cycle is maximised will be determined by the distance from the exit of the travelling wave ion guide 1 to the orthogonal acceleration region, the energy of the ions and the phase shift between that of the travelling waveform and that of the pulsing of the orthogonal acceleration Time of Flight mass spectrometer.

According to an embodiment the amplitude of the DC potential waveform may be progressively attenuated towards the entrance of the ion guide 1 i.e. the amplitude of the DC potential waveform grows to its full amplitude over the first few segments of the travelling wave ion guide 1. This allows ions to be introduced into the ion guide 1 with minimal disruption to their sequence.

A particular advantage of the preferred embodiment is that it enables ions which have become dispersed according to their mass to charge ratio or ion mobility prior to the ion guide 1 to be trapped in multiple trapping regions within the ion guide 1 so that the ions in any one particular trapping region have substantially similar physico-chemical properties. For example, the travelling wave ion guide 1 may be used in conjunction with a pulsed ion source, such as a laser ablation source or MALDI source. Alternatively, the ions may be released in a pulse from an ion trap. In either case the ions preferably pass through a region wherein they are arranged into some sequence before reaching the travelling wave ion guide 1. For example, if the ions from an ion source are accelerated to a given energy and are allowed to pass through a field free region maintained at a relatively low pressure then ions of different masses will travel at different velocities. Hence, ions of lighter mass that have higher velocities will arrive at the ion guide 1 before heavier ions having lower velocities. On arrival at the ion guide 1 ions will be effectively collected in groups according to their mass to charge ratio and transported through the travelling wave ion guide 1 as a discrete group. Ions will therefore emerge at the exit of the travelling wave ion guide 1 in packets consisting of ions with mass to charge ratios falling within a relatively narrow range. Each group of ions exiting the travelling wave ion guide 1 will have an average mass to charge ratio slightly higher than that of a preceding group which has already exited the ion guide 1. This process whereby ions are separated and packaged into groups with a similar physical property, such as mass to charge ratio, can be useful for a number of applications.

One particular application is to use a travelling wave ion guide 1 to transport ions to an ion trap, or to a discontinuous mass analyser such as a quadrupole ion trap, or FTICR mass analyser, or a Time of Flight mass analyser. When ions exit the travelling wave ion guide 1 with a given energy or when they are accelerated to a given energy then ions with different mass to charge ratios will travel with different velocities to the ion trap or mass analyser. Accordingly, if ions with a wide range of mass to charge ratios exit the travelling wave ion guide 1 then the different ions will arrive at the ion trap or mass analyser at substantially different times. In some circumstances this makes it difficult or even impossible to accommodate all the different ions. For example, if the mass analyser is an orthogonal acceleration Time of Flight mass analyser then only ions in the acceleration region at the time of the acceleration pulse will be accelerated into the Time of Flight mass analyser. However, if only ions with a relatively narrow range of mass to charge ratios or essentially the same mass to charge ratio exit the travelling wave ion guide 1 at any particular time, then the delay time of the orthogonal acceleration pulse can be effectively synchronised with the arrival of those ions at the acceleration region. In this way the sampling duty cycle for the ions released from the ion guide 1 can be as high as 100%.

The next package of ions to be released from the travelling wave ion guide 1 will also have a narrow but slightly higher range of mass to charge ratios. The delay time of the orthogonal acceleration pulse can therefore preferably be slightly increased so that it is again made to synchronise with the arrival of those ions at the acceleration region.

Accordingly, the sampling duty cycle for these ions may also be maintained at substantially 100%.

This process can preferably be repeated by progressively increasing delay times so that all the ions from the original pulsed source of ions are collected by the ion guide 1 and are transmitted through the ion guide 1. The ions are then ejected from the ion guide 1 and subsequently sampled with a 100% duty cycle by the orthogonal acceleration Time of Flight mass analyser.

The separation of ions according to their mass to charge ratio before arrival at the travelling wave ion guide 1 may take place in a field free region or in a further ion guide. The further ion guide is preferably an AC or RF ion guide although other ion guides, such as those employing guide wires, may less preferably be used.

Other means may be used to separate the stream of ions before arrival at the travelling wave ion guide 1. For example, the ions may pass through a drift tube having an axial DC voltage gradient and which is maintained at an intermediate gas pressure between 0.001 and 100 mbar, further preferably between 0.01 and 10 mbar, such that ions separate according to their ion mobility. The ions thus become separated and packaged into groups for transport through the travelling wave ion guide 1.

An ion guide 1 according to an embodiment comprises a stacked ring AC or RF ion guide 180 mm long and comprising 120 stainless steel rings each 0.5 mm thick and spaced apart by 1 mm. The internal aperture in each ring is preferably 5 mm in diameter. The frequency of the RF supply is preferably 1.75 MHz and the peak RF voltage can be varied up to 500 V. The stacked ring ion guide 1 is preferably positioned in an enclosed collision cell chamber positioned between the two quadrupole mass filters/analysers in a triple quadrupole mass spectrometer. The pressure in the enclosed collision cell chamber may be varied up to 0.01 mbar. The stacked ring AC or RF ion guide 1 may in one embodiment be electrically divided into 15 segments each 12 mm long and consisting of 8 rings. Three different DC voltages may be connected to every third segment such that the sequence of voltages applied to the first three segments is repeated a further four times along the whole length of the stacked ring set. The three DC voltages applied to every third segment may be independently programmed up to 40 V. The sequence of voltages applied to each segment may create DC potential waveforms with a potential hill, repeated five times throughout the length of the stacked ring set. For this particular embodiment the wavelength of the travelling DC potential waveform is 36 mm (3×12 mm). The cycle time for the sequence of voltages on any one segment was 23 $\mu$s. Hence, the wave velocity was 1560 m/s (36 mm/23 $\mu$s).

Figure 3:
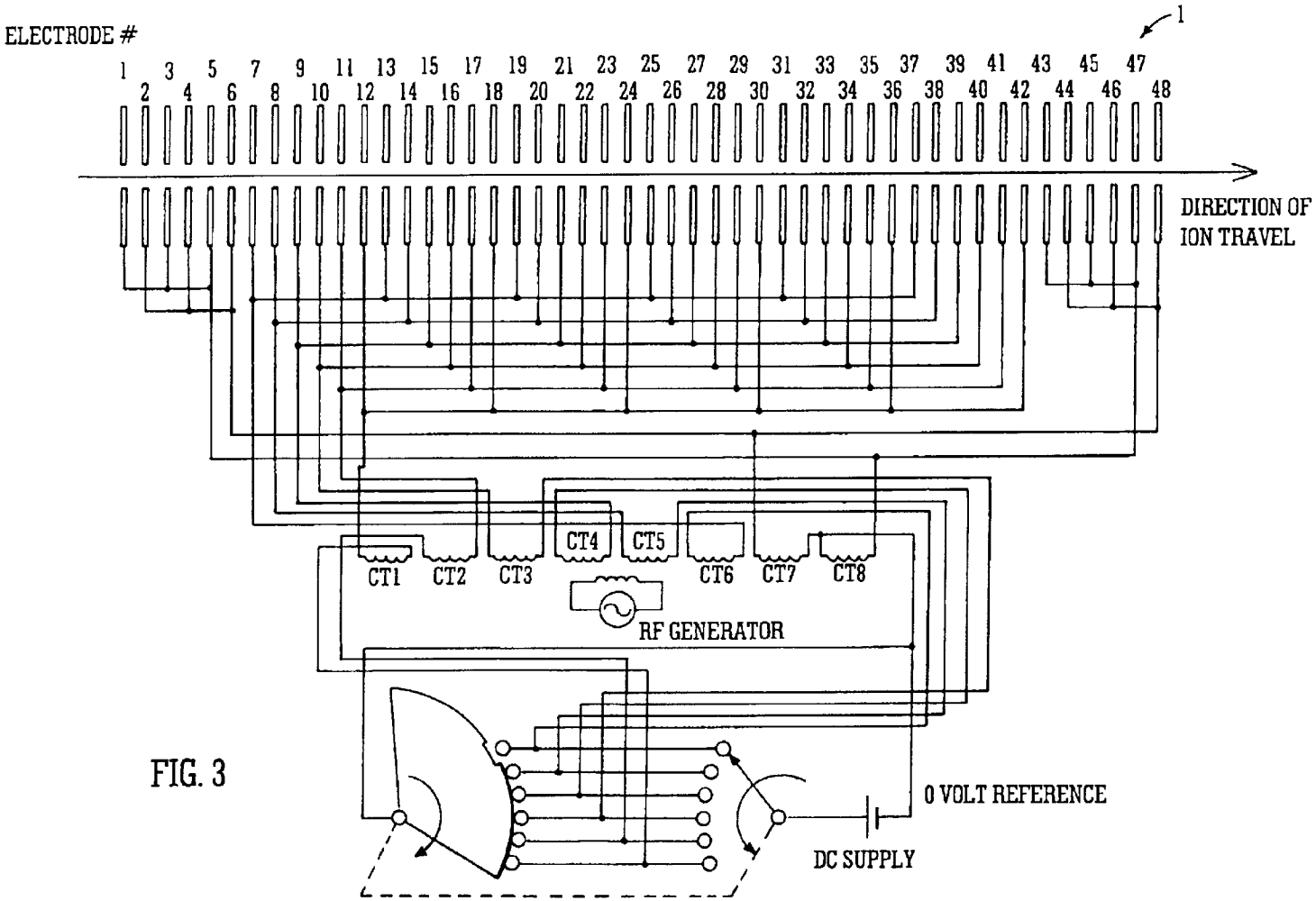
FIG. 3 illustrates how a repeating transient DC voltage waveform may be generated.

The operation of a travelling wave ion guide 1 will now be described with reference to FIG. 3. The preferred embodiment preferably comprises 120 electrodes but 48 electrodes are shown in FIG. 3 for ease of illustration.

Alternate electrodes are preferably fed with opposite phases of a RF supply (preferably 1 MHz and 500 V p-p). The ion guide 1 may be divided into separate groups of electrodes (6 groups of electrodes are shown in FIG. 3). The electrodes in each group may be fed from separate secondary windings on a coupling transformer as shown in FIG. 3. These are connected so that all the even-numbered electrodes are 180° out of phase with all the odd-numbered electrodes. Therefore, at the point in the RF cycle when all the odd numbered electrodes are at the peak positive voltage, all the even-numbered electrodes are at the peak negative voltage.

Groups of electrodes at each end of the ion guide 1 (e.g. electrodes #1–6 and #43–48) may be supplied with RF only potentials whereas the central groups (e.g. electrodes #7–12, #13–18, #19–24, #25–30, #31–36 and #37–42) may be supplied with both RF and DC potentials. Electrodes #1, #3, #5, #43, #45 and #47 may be connected to one pole of the secondary winding CT8 and electrodes #2, #4, #6, #44, #46 and #48 may be connected to the opposite end of winding CT7 to ensure the correct RF phasing of the electrodes. The other ends of these windings are connected to the 0 V DC reference so that only RF potentials are applied to the end groups of electrodes. Electrodes #7, #13, #19, #24, #31 and #37 which are the first electrodes of each of the central groups are connected together and fed from secondary winding CT6. Windings CT5, CT4, CT3, CT2 and CT1 respectively supply the second through sixth electrodes of each of central groups. Each of windings CT1–6 is referred to a different DC reference point shown schematically by the 2-gang switch in FIG. 3 so that the first through sixth sets of electrodes of the central groups of electrodes can be supplied with a DC potential selected by the switch, as well as the RF potentials.

In the preferred mode of operation only one set of interconnected electrodes comprised in the central groups is supplied with a DC voltage at any given instant. All the other windings are referenced to 0V DC at that particular instant. For example, with the switch in the position illustrated in FIG. 3, winding CT6 of the transformer may be connected to the DC supply biasing all the first electrodes (e.g. electrodes #7, #13, #19 etc.) of the central groups relative to all other electrodes.

If the switch is then moved to the next position, winding CT5 is connected to the DC supply, biasing all the second electrodes (e.g. electrodes #8, #14, #20 etc.) while the first electrodes (e.g. electrodes #7, #13, #19 etc.) are returned to 0 V DC.

When used as a travelling wave ion guide 1 the switch can be effectively rotated continuously biasing in turn the first through sixth electrodes and then repeating the sequence without interruption. A mechanical switch is shown in FIG. 3 for sake of illustration. Electronic switching may more preferably be used to carry out the switching. Each transformer winding CT1–8 may be fed by a Digital to Analogue Converter which can apply the desired DC potential to the winding under computer control.

Typical operating conditions may have an RF peak-to-peak voltage of 500 V, an RF frequency of 1 MHz, a DC bias of +5 V (for positive ions) and a switching frequency of 10–100 kHz.

If a positive ion enters the ion guide 1 when the switch is in the position shown in FIG. 3 and a positive DC potential is applied to electrode #7 then the ion will encounter a potential barrier at electrode #7 which prevents its further passage along the ion guide 1 (assuming that its translational kinetic energy is not too high). As soon as the switch moves to the next position, however, this potential barrier will shift to electrode #8 and then electrode #9, #10, #11 and #12 upon further rotation of the switch. This allows the ion to move further along the ion guide 1. On the next cycle of operation of the switch, the barrier in front of the ion moves to electrode #13 and a new potential barrier now appears on electrode #7 behind the ion. The ion therefore becomes contained or otherwise trapped in a potential well between the potential barriers on electrodes #7 and #13. Further rotation of the switch moves this potential well from electrodes #7–13 to electrodes #8–14, then #9–15, through to

#12–18. A further cycle of the switch moves this potential well in increments of one electrode from electrodes #12–18 through to electrodes #18–24. The process repeats thereby pushing the ion along the ion guide 1 in its potential well until it emerges into the RF only exit group of electrodes #43–48 and then subsequently leaves the ion guide 1.

As a potential well moves along the ion guide 1, new potential wells capable of containing more ions may be created and moved along behind it. The travelling wave ion guide 1 therefore carries individual packets of ions along its length in the travelling potential wells while simultaneously the strong focusing action of the RF field tends to confine the ions to the axial region.

According to a particularly preferred embodiment a mass spectrometer is provided having two quadrupole mass filters/analysers and a collision cell. A travelling wave ion guide 1 may be provided upstream of the first mass filter/analyser. A transient DC potential waveform may be applied to the travelling wave ion guide 1 having a wavelength of 14 electrodes. The DC voltage is preferably applied to neighbouring pairs of electrodes 2 and is preferably stepped in pairs. Hence, according to the preferred embodiment there are seven steps in one cycle. Therefore, at any one time there are two electrodes with a transient applied DC voltage followed by 12 electrodes with no applied DC voltage followed by two electrodes with a transient applied DC voltage followed by 12 electrodes with no applied DC voltage etc.

A buffer gas (typically nitrogen or helium) may be introduced into the travelling wave ion guide 1. If the ion guide 1 is used to interface a relatively high pressure source to a high-vacuum mass analyser or is used as a collision cell then gas will already be present in the ion guide 1. The buffer gas is a viscous medium and is preferably provided to dampen the motion of the ions. The presence of gas tends to thermalise the ion translational energies. Therefore, ions entering the ion guide 1 may become thermalised by collisional cooling irrespective of the kinetic energy possessed by the ions and they will be confined in their potential wells as they travel through the ion guide 1. Assuming that the potential barriers are sufficiently high to ensure the ions remain in the potential well, their transit time through the ion guide 1 will be independent of both their initial kinetic energy and the gas pressure. The ion transit time will therefore be determined solely by the rate at which the potential wells are moved or translated along the ion guide 1 and will be a function of the switching rate of the electrode potentials. This property can be exploited advantageously in a number of applications and leads to improvements in performance when compared to instruments using conventional rod-set guides in which this control is unavailable.

Figure 4:
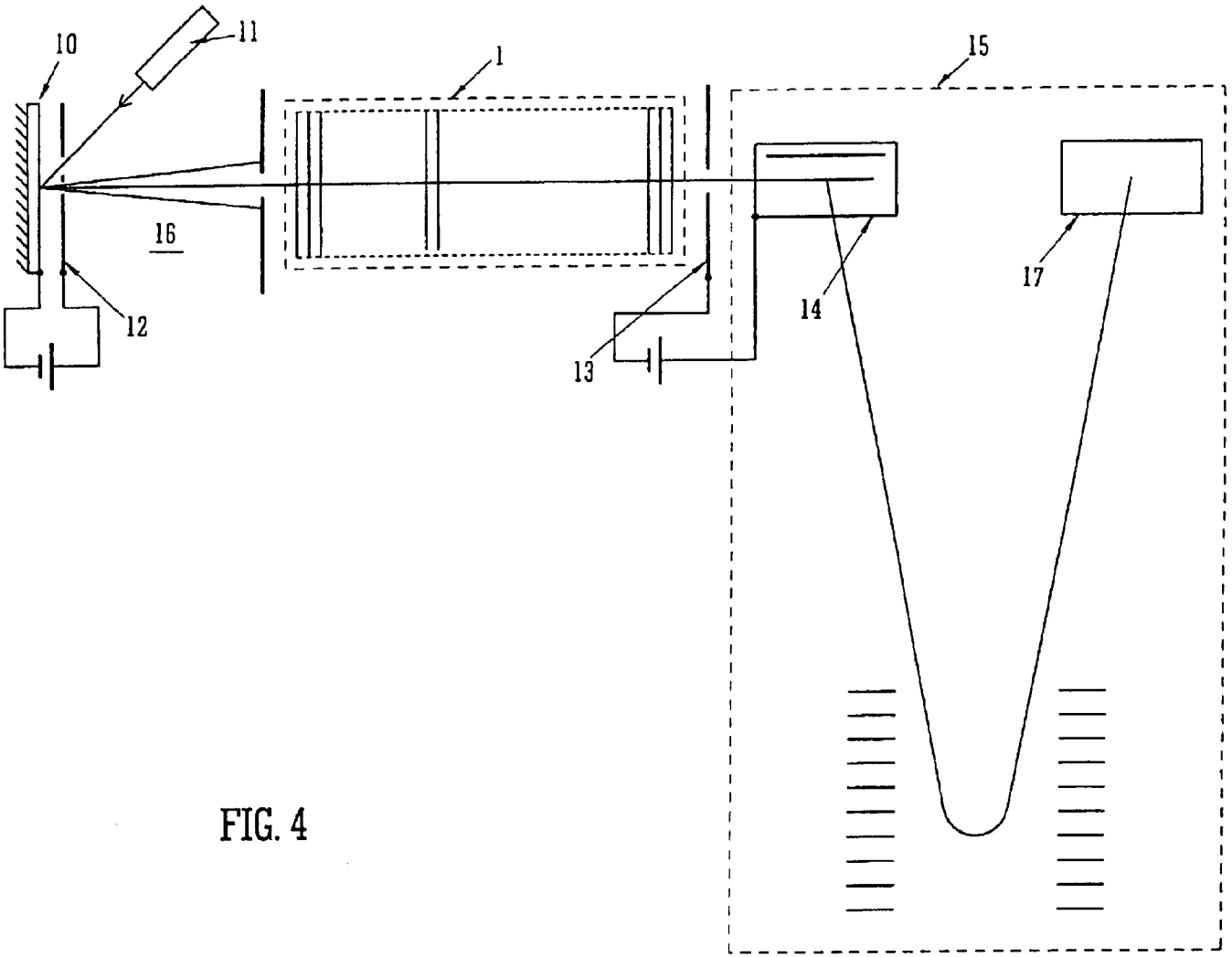
FIG. 4 shows a preferred embodiment of the present invention.

A particularly preferred embodiment is shown in FIG. 4. The travelling wave ion guide 1 advantageously allows the ion transit time to be controlled unlike other ion guides and in particular allows a MALDI-TOF instrument to be operated in a very efficient way with virtually a 100% ion transmission and analysis efficiency.

A sample to be analysed is coated on a target 10 and is bombarded with photons from a laser 11. Ions so produced pass through an aperture in an extraction electrode 12 and then through a travelling wave ion guide 1 according to the preferred embodiment. On exiting the travelling wave ion guide 1 they pass through an exit electrode 13 and enter the pulser 14 of a Time of Flight mass analyser 15. A linear or a reflecting Time of Flight mass analyser 15 may be provided. An orthogonal reflecting type is preferred and is shown in FIG. 4. Operation of the pulser 14 and Time of Flight mass analyser 15 is conventional. Gas (e.g. nitrogen) may be introduced into the travelling wave ion guide 1 at e.g. a pressure of between $10^{-3}$ and 1 mbar in order to provide collisional cooling of the ions as they are carried through the travelling wave ion guide 1.

An accelerating region is preferably provided between the target 10 and the extraction electrode 12 and a 10 V potential gradient may be provided to accelerate positive ions as shown. This region is preferably followed by a field-free region 16 between the extraction electrode 12 and the entrance of the travelling wave ion guide 1. According to an embodiment the length of the field free region 16 is 250 mm.

Another accelerating field may be provided between the travelling wave ion guide exit electrode 13 and the Time of Flight pulser 14, as shown. A 40 V potential gradient may, for example, be provided in this region.

The accelerating fields and the field-free region 16 interact with the operation of the travelling wave ion guide 1 to enable a mode of operation which is highly efficient. The ion source, acceleration regions and field-free region 16 are preferably maintained at relatively high vacuum.

It is known that the majority of ions ejected from the MALDI target 10 will have a range of velocities typically between about 0.5 and 2.0 times the speed of sound, on average about 300–400 m/s. This spread in velocities accounts for the relatively large spread in ion energies. In the embodiment shown in FIG. 4 an accelerating field exists between the target 10 and the extraction electrode 12 so that the ions gain an equal amount of kinetic energy on passing through the field which adds a mass dependent component of velocity to their approximately constant ejection velocity. Since kinetic energy KE:

$$KE = \frac{mv^2}{2}$$

then if the energy is constant, the added velocity is proportional to $1/\sqrt{m}$.

The ions then enter a field-free drift region 16 between the extraction electrode 12 and the entrance of the travelling wave ion guide 1 in which they begin to separate according to their mass to charge ratios because of the different mass-dependent velocities imparted to them during the prior acceleration stage. Consequently, the lightest ions arrive first at the entrance to the travelling wave ion guide 1. These ions will enter the travelling wave ion guide 1 and become trapped in a DC potential well. As that DC potential well moves or is translated along the length of travelling wave ion guide 1, a second DC potential well opens behind it into which some slightly heavier ions will become trapped. These ions will have taken slightly longer to reach the travelling wave ion guide entrance because they will have moved slightly more slowly through the field free region 16 than the lightest ions. Thus it will be seen that the combined effect of the accelerating region, field-free region 16 and the travelling DC potential wells of the travelling wave ion guide 1 results in a series of DC potential wells reaching the end of the travelling wave ion guide 1 with each potential well or trapping region containing ions of similar mass to charge ratios. The first potential well or trapping region arriving at the exit of the travelling wave ion guide 1 will contain the lightest ions, the following potential wells or trapping regions will contain ions of steadily increasing mass to charge ratios and the last potential well or trapping region will contain the heaviest ions from any particular laser pulse.

Since the ions remain trapped in their potential wells during their passage or translation through the traveling wave ion guide 1, the ions preferably do not mix with ions in different potential wells. Since gas is present in the travelling wave ion guide 1 this results in collisional cooling of the ions in each potential well whilst the travelling potential well continues to push the ions forward at a velocity equal to that of the potential well. Consequently, by the time the ions reach the end of the travelling wave ion guide 1 the ions in each potential well will have lost most of their initial velocity spread even though they have a bulk velocity equal to that of the potential well. In other words, their initial relatively large spread in energy is reduced to that of the thermal energy of the buffer gas.

When the first potential well (containing the lightest ions with substantially only thermal energies) reaches the end of the travelling wave ion guide 1 the front potential barrier disappears and the rear potential barrier pushes the ions out of the travelling wave ion guide 1 into another accelerating field between the exit of the travelling wave ion guide 1 and the pusher electrodes of the Time of Flight mass analyser 15. Typically, a gradient of about 40 V may be applied. This field rapidly accelerates the ions into the pusher region 14, but because they all start with similar (very low) kinetic energy and because the potential well contains only ions having a limited range of masses, the ions do not significantly separate in space during this acceleration. The slowest ions released from the potential well will therefore still enter the pusher region 14 before the fastest ions can exit the pusher region 14. Consequently, if the pusher voltage is applied at this precise time then all the ions contained in a particular potential well or trapping region can be analysed by the Time of Flight mass analyser 15 without loss. Advantageously, a single TOF push, synchronised with but delayed from the arrival of a potential well at the exit of the travelling wave ion guide 1 may be used to analyse all the ions in a potential well. The preferred embodiment is therefore capable of mass analysing all the ions from a given laser pulse with virtually a 100% efficiency.

The preferred embodiment can be yet further refined by varying the travelling wave ion guide switching speed during the arrival of ions at the travelling wave ion guide 1 following a laser pulse. The collection of ions into individual potential wells will proceed with least disruption to their grouping by mass to charge ratio if the velocity of the potential wells is arranged to substantially match the velocities of the ions arriving at the entrance to the travelling wave ion guide 1. The ions arriving at the travelling wave ion guide 1 from each laser pulse will have progressively slower velocities as the elapsed time from the laser pulse increases as their velocity is simply the length of the field free region 16 from the target plate 10 to the travelling wave ion guide 1 divided by the elapsed time. Accordingly, the velocity of the potential wells in the travelling wave ion guide 1 may be continuously reduced so as to continuously match the velocity of the ions arriving at the entrance of the travelling wave ion guide 1. This can be achieved by arranging the travelling wave ion guide switching time intervals to increase linearly with elapsed time from the laser pulse.

As a consequence, the velocities of the ions within potential wells within the travelling wave ion guide 1 will also preferably continuously reduce. Since the ions have a natural tendency to slow due to the viscous drag of the collision gas, by appropriate selection of gas type and pressure the natural slowing of ions due to viscous drag can be made to substantially match the slowing velocity of the potential wells in the travelling wave ion guide 1 thereby reducing the chances of any ions fragmenting unintentionally in the ion guide 1.

Another advantage of this arrangement is that the energy of the ions leaving the travelling wave ion guide 1 is approximately constant (otherwise, the energy of the ions would increase with the increasing mass of the ions in the later arriving potential wells). The ions therefore leave the travelling wave ion guide 1 with substantially the velocity of the potential barriers moving along the travelling wave ion guide 1. If the traveling DC wave velocity is kept constant then ions with higher masses will have greater kinetic energies than ions with lower masses. However, ions entering an orthogonal Time of Flight mass analyser 15 should preferably all have approximately the same energy in order to avoid spatial separation of ions when they arrive at the ion detector 17. It is therefore necessary for all ions to have substantially the same energy in order to ensure that all the ions ultimately hit the ion detector 17. This can be achieved by reducing the velocity of the potential barriers as the heavier masses arrive at and leave the travelling wave ion guide 1. If the velocity of the potential wells is reduced by arranging the travelling wave ion guide switching time intervals to increase linearly with elapsed time from the laser pulse, then the ions all advantageously exit the travelling wave ion guide 1 with approximately the same energy independent of their mass.

In order to allow for the lower velocity of the higher mass ions, the delay between the arrival of a potential well at the exit of the travelling wave ion guide 1 and the operation of the Time of Flight pulser 14 is preferably increased in synchronism with the increased switching time intervals of the travelling wave ion guide operation.

A theoretical treatment of the effect of gas collisions in the travelling wave ion guide 1 or the transport of ions in the potential well shows that the potential well translation velocity (i.e. the switching speed of the travelling wave ion guide) should be reduced exponentially during the time the laser desorbed ions are arriving at the travelling wave ion guide.

Figure 5:
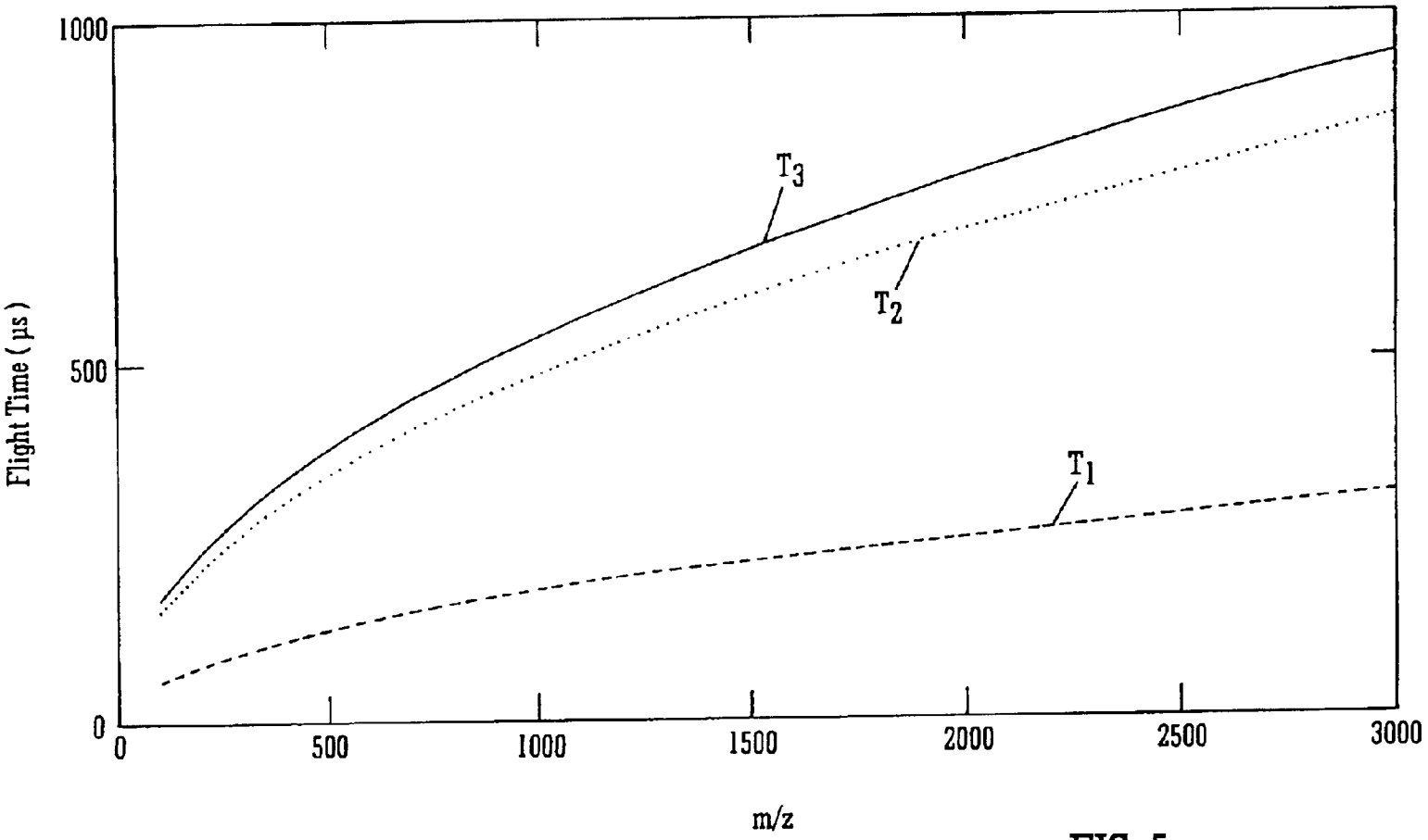
FIG. 5 shows a graph illustrating the arrival time $T_1$ of ions arriving at the preferred ion guide, the time $T_2$ that the ions exit the preferred ion guide and the arrival time $T_3$ of the ions at a pusher electrode of an orthogonal acceleration Time of Flight mass analyser for ions of varying mass to charge ratio.

FIG. 5 illustrates how ions of differing mass to charge ratios will arrive at the travelling wave ion guide 1 shown in FIG. 4 as a function of time $T_1$. FIG. 5 also illustrates the exit time $T_2$ of the ions from the travelling wave ion guide 1 and the arrival time $T_3$ of the ions at the orthogonal acceleration Time of Flight mass analyser 15.

The curves shown in FIG. 5 assume that ions are released or generated at time T=0 and are accelerated by a voltage $V_1$ of 10 V. The ions will therefore have an energy of $E_1$ (eV) where $E_1$=10. The distance $L_1$ (m) from the pulsed ion source 10, 11 to the entrance of the travelling wave ion guide 1 is 0.25 m. The arrival time $T_1$ for ions at the entrance to the travelling wave ion guide 1 is therefore given by;

$$T_1 = 72L_1\sqrt{\frac{m}{E_1}}$$

The velocity v (m/s) of the transient DC voltage waveform and/or of the ions arriving at the travelling wave ion guide 1 is given by:

$$v = \frac{L_1}{T_1} \cdot 10^6$$

The length $L_2$ (m) of the travelling wave ion guide is 0.25 m. The time $T_2$ at which ions exit the travelling wave ion guide 1 is given by:

$$T_2 = T_1 e^{\left(\frac{L_2}{L_1}\right)}$$

The velocity $v_x$ of the transient DC voltage waveform and/or the ions at the exit of the travelling wave ion guide 1:

$$v_x = v e^{-\left(\frac{L_2}{L_1}\right)}$$

The energy $E_2$ (eV) of ions at the exit of the travelling wave ion guide 1 is:

$$E_2 = E_1 e^{-2\left(\frac{L_2}{L_1}\right)}$$

and hence:

$$E_2=1.353$$

The ions are further accelerated by a voltage $V_3$ (V) at the exit of the travelling wave ion guide 1:

$$V_3=38.647$$

The energy $E_3$ (eV) of the ions therefore after acceleration;

$$E_3=E_2+V_3$$

where $E_3$=40. The path length $L_3$ (m) from the travelling wave ion guide 1 to the orthogonal acceleration pusher region is 0.15 m. The flight time $T_x$ from the exit of the travelling wave ion guide 1 to the orthogonal acceleration pusher region 14:

$$T_x = 72L_3\sqrt{\frac{m}{E_3}}$$

The arrival time $T_3$ at the orthogonal acceleration pusher region:

$$T_3=T_2+T_x$$

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a device for temporally or spatially dispersing a group of ions according to a physico-chemical property;

an ion guide comprising a plurality of electrodes, said ion guide receiving in use at least some of the ions which have become dispersed according to said physico-chemical property;

wherein multiple trapping regions are generated or created along at least a portion of the length of said ion guide wherein at least a first group of ions having a physico-chemical property within a first range are trapped within a first trapping region and a second group of ions having a physico-chemical property within a second different range are trapped within a second different trapping region and wherein said multiple trapping regions are translated along at least a portion of the length of said ion guide.

2. A mass spectrometer as claimed in claim 1, wherein at least a majority of ions trapped within said first trapping region and/or at least a majority of ions trapped within said second trapping region have substantially the same or similar said physico-chemical property.

3. A mass spectrometer as claimed in claim 1, wherein said physico-chemical property is mass to charge ratio.

4. A mass spectrometer as claimed in claim 3, further comprising a field free region arranged upstream of said ion guide wherein ions which have been accelerated to have substantially the same kinetic energy become dispersed according to their mass to charge ratio.

5. A mass spectrometer as claimed in claim 4, wherein said field free region is provided within an ion guide.

6. A mass spectrometer as claimed in claim 5, wherein said ion guide is selected from the group consisting of: (i) a quadrupole rod set; (ii) a hexapole rod set; (iii) an octopole or higher order rod set; (iv) an ion tunnel ion guide comprising a plurality of electrodes having apertures through which ions are transmitted, said apertures being substantially the same size; (v) an ion funnel ion guide comprising a plurality of electrodes having apertures through which ions are transmitted, said apertures becoming progressively smaller or larger; and (vi) a segmented rod set.

7. A mass spectrometer as claimed in claim 3, further comprising a pulsed ion source wherein in use a packet or ions emitted by said pulsed ion source enters said field free region.

8. A mass spectrometer as claimed in claim 3, further comprising an ion-trap arranged upstream of the field free region wherein in use said ion trap releases a packet of ions which enters said field free region.

9. A mass spectrometer as claimed in claim 1, wherein said physico-chemical property is ion mobility.

10. A mass spectrometer as claimed in claim 9, further comprising a drift region arranged upstream of said ion trap wherein ions become dispersed according to their ion mobility.

11. A mass spectrometer as claimed in claim 10, wherein said drift region has a constant axial electric field or a time varying axial electric field.

12. A mass spectrometer as claimed in claim 10, wherein said drift region is provided within an ion guide.

13. A mass spectrometer as claimed in claim 12, wherein said ion guide is selected from the group consisting of: (i) a quadrupole rod set; (ii) a hexapole rod set; (iii) an octopole or higher order rod set; (iv) an ion tunnel ion guide comprising a plurality of electrodes having apertures through which ions are transmitted, said apertures being substantially the same size; (v) an ion funnel ion guide comprising a plurality of electrodes having apertures through which ions are transmitted, said apertures becoming progressively smaller or larger; and (vi) a segmented rod set.

14. A mass spectrometer as claimed in claim 10, further comprising a pulsed ion source wherein in use a packet of ions emitted by said pulsed ion source enters said drift region.

15. A mass spectrometer as claimed in claim 10, further comprising an ion trap arranged upstream of the drift region wherein in use said ion trap releases a packet of ions which enters said drift region.

16. A mass spectrometer comprising:

a mass to charge ratio selective ion trap which releases in use at least a first group of ions having mass to charge ratios within a first range and then at least a second group of ions having mass to charge ratios within a second range;

an ion guide comprising a plurality of electrodes arranged to receive at least some of said first group of ions and at least some of said second group of ions;

wherein multiple trapping regions are generated or created along at least a portion of the length of said ion guide wherein at least some of the ions of said first group are trapped within a first trapping region and at least some of the ions of said second group are trapped within a second different trapping region; and wherein said multiple trapping regions are translated along at least a portion of the length of said ion guide.

17. A mass spectrometer as claimed in claim 16, wherein said mass to charge ratio selective ion trap is selected from the group consisting of: (i) a 2D (linear) quadrupole ion trap; (ii) a 3D quadrupole ion trap; and (iii) a Penning ion trap.

18. A mass spectrometer as claimed in claim 16, wherein at least a majority of the ions trapped within said first trapping region have substantially the same mass to charge ratio and/or at least a majority of the ions trapped within said second trapping region have substantially the same mass to charge ratio.

19. A mass spectrometer as claimed in claim 16, wherein at least a majority of the ions trapped within said first trapping region have mass to charge ratios which differ by less than x mass to charge ratio units and/or at least a majority of the ions trapped within said second trapping region have mass to charge ratios which differ by less than x mass to charge ratio units, wherein x is selected from the group consisting of: (i) 500; (ii) 450; (iii) 400; (iv) 350; (v) 300; (vi) 250; (vii) 200; (viii) 150; (ix) 100; (x) 90; (xi) 80; (xii) 70; (xiii) 60; (xiv) 50; (xv) 40; (xvi) 30; (xvii) 20; (xviii) 10; and (xix) 5.

20. A mass spectrometer as claimed in claim 16, wherein at least a majority of the ions trapped within said first trapping region and/or at least a majority of the ions trapped within said second trapping region have mass to charge ratios which differ by less than: (i) 30%; (ii) 25%; (iii) 20%; (iv) 15%; (v) 10%; (vi) 5%; (vii) 4%; (viii) 3%; (ix) 2%; or (x) 1%.

21. A mass spectrometer as claimed in claim 16, wherein one or more transient DC voltages or one or more transient DC voltage waveforms are progressively applied to said electrodes so that ions are urged along said ion guide.

22. A mass spectrometer as claimed in claim 16, wherein an axial voltage gradient is maintained along at least a portion of the length of said ion guide and wherein said axial voltage gradient varies with time whilst ions are being transmitted through said ion guide.

23. A mass spectrometer as claimed in claim 16, wherein said ion guide comprises a first electrode held at a first reference potential, a second electrode held at a second reference potential, and a third electrode held at a third reference potential, wherein:

at a first time $t_1$ a first DC voltage is supplied to said first electrode so that said first electrode is held at a first potential above or below said first reference potential;

at a second later time $t_2$ a second DC voltage is supplied to said second electrode so that said second electrode is held at a second potential above or below said second reference potential; and at a third later time $t_3$ a third DC voltage is supplied to said third electrode so that said third electrode is held at a third potential above or below said third reference potential.

24. A mass spectrometer as claimed in claim 23, wherein:

at said first time $t_1$ said second electrode is at said second reference potential and said third electrode is at said third reference potential;

at said second time $t_2$ said first electrode is at said first potential and said third electrode is at said third reference potential; and at said third time $t_3$ said first electrode is at said first potential and said second electrode is at said second potential.

25. A mass spectrometer as claimed in claim 23, wherein:

at said first time $t_1$ said second electrode is at said second reference potential and said third electrode is at said third reference potential;

at said second time $t_2$ said first electrode is no longer supplied with said first DC voltage so that said first electrode is returned to said first reference potential and said third electrode is at said third reference potential; and at said third time $t_3$ said first electrode is at said first reference potential and said second electrode is no longer supplied with said second DC voltage so that said second electrode is returned to said second reference potential.

26. A mass spectrometer as claimed in claim 23, wherein said first, second and third reference potentials are substantially the same.

27. A mass spectrometer as claimed in claim 23, wherein said first, second and third DC voltages are substantially the same.

28. A mass spectrometer as claimed in claim 23, wherein said first, second and third potentials are substantially the same.

29. A mass spectrometer as claimed in claim 16, wherein said ion guide comprises 3, 4, 5, 6, 7, 8, 9, 10, 11, 12, 13, 14, 15, 16, 17, 18, 19, 20, 21, 22, 23, 24, 25, 26, 27, 28, 29, 30 or >30 segments, wherein each segment comprises 1, 2, 3, 4, 5, 6, 7, 8, 9, 10, 11, 12, 13, 14, 15, 16, 17, 18, 19, 20, 21, 22, 23, 24, 25, 26, 27, 28, 29, 30 or >30 electrodes and wherein the electrodes in a segment are maintained at substantially the same DC potential.

30. A mass spectrometer as claimed in claim 29, wherein a plurality of segments are maintained at substantially the same DC potential.

31. A mass spectrometer as claimed in claim 29, wherein each segment is maintained at substantially the same DC potential as the subsequent nth segment wherein n is 3, 4, 5, 6, 7, 8, 9, 10, 11, 12, 13, 14, 15, 16, 17, 18, 19, 20, 21, 22, 23, 24, 25, 26, 27, 28, 29, 30 or >30.

32. A mass spectrometer as claimed in claim 16, wherein ions are confined radially within said ion guide by an AC or RF electric field.

33. A mass spectrometer as claimed in claim 16, wherein ions are radially confined within said ion guide in a pseudo-potential well and are constrained axially by a real potential barrier or well.

34. A mass spectrometer as claimed in claim 16, wherein the transit time of ions through said ion guide is selected from the group consisting of: (i) less than or equal to 20 ms; (ii) less than or equal to 10 ms; (iii) less than or equal to 5 ms; (iv) less than or equal to 1 ms; and (v) less than or equal to 0.5 ms.

35. A mass spectrometer as claimed in claim 16, wherein said ion guide and/or said drift region is maintained, in use, at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

36. A mass spectrometer as claimed in claim 16, wherein said ion guide and/or said drift region is maintained, in use, at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar; and (xi) less than or equal to 0.0001 mbar.

37. A mass spectrometer as claimed in claim 16, wherein said ion guide and/or said drift region is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

38. A mass spectrometer as claimed in claim 16, wherein said field free region is maintained, in use, at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

39. A mass spectrometer as claimed in claim 16, wherein said field free region is maintained, in use, at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

40. A mass spectrometer as claimed in claim 16, wherein said field free region is maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

41. A mass spectrometer as claimed in claim 16, wherein said ion guide and/or said drift region are maintained, in use, at a pressure such that a viscous drag is imposed upon ions passing through said ion guide and/or said drift region.

42. A mass spectrometer as claimed in claim 16, wherein in use one or more transient DC voltages or one or more transient DC voltage waveforms are initially provided at a first axial position and are then subsequently provided at second, then third different axial positions along said ion guide.

43. A mass spectrometer as claimed in claim 16, wherein one or more transient DC voltages or one or more transient DC voltage waveforms move in use from one end of said ion guide to another end of said ion guide so that ions are urged along said ion guide.

44. A mass spectrometer as claimed in claim 42, wherein said one or more transient DC voltages create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

45. A mass spectrometer as claimed in claim 42, wherein said one or more transient DC voltage waveforms comprise a repeating waveform.

46. A mass spectrometer as claimed in claim 45, wherein said one or more transient DC voltage waveforms comprise a square wave.

47. A mass spectrometer as claimed in claim 42, wherein the amplitude of said one or more transient DC voltages or said one or more transient DC voltage waveforms remains substantially constant with time.

48. A mass spectrometer as claimed in claim 42, wherein the amplitude of said one or more transient DC voltages or said one or more transient DC voltage waveforms varies with time.

49. A mass spectrometer as claimed in claim 48, wherein the amplitude of said one or more transient DC voltages or said one or more transient DC voltage waveforms either: (i) increases with time; (ii) increases then decreases with time; (iii) decreases with time; or (iv) decreases then increases with time.

50. A mass spectrometer as claimed in claim 42, wherein said ion guide comprises an upstream entrance region, a downstream exit region and an intermediate region, wherein:

in said entrance region the amplitude of said one or more transient DC voltages or said one or more transient DC voltage waveforms has a first amplitude;

in said intermediate region the amplitude of said one or more transient DC voltages or said one or more transient DC voltage waveforms has a second amplitude; and in said exit region the amplitude of said one or more transient DC voltages or said one or more transient DC voltage waveforms has a third amplitude.

51. A mass spectrometer as claimed in claim 50, wherein the entrance and/or exit region comprise a proportion of the total axial length of said ion guide selected from the group consisting of: (i)<5%; (ii) 5–10%; (iii) 10–15%; (iv) 15–20%; (v) 20–25%; (vi) 25–30%; (vii) 30–35%; (viii) 35–40%; and (ix) 40–45%.

52. A mass spectrometer as claimed in claim 50, wherein said first and/or third amplitudes are substantially zero and said second amplitude is substantially non-zero.

53. A mass spectrometer as claimed in claim 50, wherein said second amplitude is larger than said first amplitude and/or said second amplitude is larger than said third amplitude.

54. A mass spectrometer as claimed in claim 42, wherein said one or more transient DC voltages or said one or more transient DC voltage waveforms pass in use along said ion guide with a first velocity.

55. A mass spectrometer as claimed in claim 54, wherein said first velocity: (i) remains substantially constant; (ii) varies; (iii) increases; (iv) increases then decreases; (v) decreases; (vi) decreases then increases; (vii) reduces to substantially zero; (viii) reverses direction; or (ix) reduces to substantially zero and then reverses direction.

56. A mass spectrometer as claimed in claim 42, wherein said one or more transient DC voltages or said one or more transient DC voltage waveforms cause ions within said ion guide to pass along said ion guide with a second velocity.

57. A mass spectrometer as claimed in claim 56, wherein the difference between said first velocity and said second velocity is less than or equal to 100 m/s, 90 m/s, 80 m/s, 70 m/s, 60 m/s, 50 m/s, 40 m/s, 30 m/s, 20 m/s, 10 m/s, 5 m/s or 1 m/s.

58. A mass spectrometer as claimed in claim 54, wherein said first velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

59. A mass spectrometer as claimed in claim 56, wherein said second velocity is selected from the group consisting of: (i) 10–250 m/s; (ii) 250–500 m/s; (iii) 500–750 m/s; (iv) 750–1000 m/s; (v) 1000–1250 m/s; (vi) 1250–1500 m/s; (vii) 1500–1750 m/s; (viii) 1750–2000 m/s; (ix) 2000–2250 m/s; (x) 2250–2500 m/s; (xi) 2500–2750 m/s; and (xii) 2750–3000 m/s.

60. A mass spectrometer as claimed in claim 56, wherein said second velocity is substantially the same as said first velocity.

61. A mass spectrometer as claimed in claim 42, wherein said one or more transient DC voltages or said one or more transient DC voltage waveforms have a frequency, and wherein said frequency: (i) remains substantially constant; (ii) varies; (iii) increases; (iv) increases then decreases; (v) decreases; or (vi) decreases then increases.

62. A mass spectrometer as claimed in claim 42, wherein said one or more transient DC voltages or said one or more transient DC voltage waveforms have a wavelength, and wherein said wavelength: (i) remains substantially constant; (ii) varies; (iii) increases; (iv) increases then decreases; (v) decreases; or (vi) decreases then increases.

63. A mass spectrometer as claimed in claim 42, wherein two or more transient DC voltages or two or more transient DC voltage waveforms are arranged to move: (i) in the same direction; (ii) in opposite directions; (iii) towards each other; (iv) away from each other.

64. A mass spectrometer as claimed in claim 42, wherein said one or more transient DC voltages or said one or more transient DC voltage waveforms are repeatedly generated and passed in use along said ion guide, and wherein the frequency of generating said one or more transient DC voltages or said one or more transient DC voltage waveforms: (i) remains substantially constant; (ii) varies; (iii) increases; (iv) increases then decreases; (v) decreases; or (vi) decreases then increases.

65. A mass spectrometer as claimed in claim 42, wherein said one or more transient DC voltages or said one or more transient DC voltage waveforms has a wavelength which remains substantially the same and a frequency which decreases with time so that the velocity of said one or more transient DC voltages or said one or more transient DC voltages decreases with time.

66. A mass spectrometer as claimed in claim 16, wherein in use pulses of ions emerge from an exit of said ion guide.

67. A mass spectrometer as claimed in claim 66, further comprising an ion detector, said ion detector being arranged to be substantially phase locked in use with the pulses of ions emerging from the exit of the ion guide.

68. A mass spectrometer as claimed in claim 66, further comprising a Time of Flight mass analyser comprising an electrode for injecting ions into a drift region, said electrode being arranged to be energised in use in a substantially synchronised manner with the pulses of ions emerging from the exit of the ion guide.

69. A mass spectrometer as claimed in claim 66, further comprising an ion trap arranged downstream of said ion guide, said ion trap being arranged to store and/or release ions from said ion trap in a substantially synchronised manner with the pulses of ions emerging from the exit of the ion guide.

70. A mass spectrometer as claimed in claim 66, further comprising an mass filter arranged downstream of said ion guide, wherein a mass to charge ratio transmission window of said mass filter is varied in a substantially synchronised manner with the pulses of ions emerging from the exit of the ion guide.

71. A mass spectrometer as claimed in claim 16, wherein said ion guide is selected from the group consisting of: (i) an ion funnel comprising a plurality of electrodes having apertures therein through which ions are transmitted, wherein the diameter of said apertures becomes progressively smaller or larger; (ii) an ion tunnel comprising a plurality of electrodes having apertures therein through which ions are transmitted, wherein the diameter of said apertures remains substantially constant; and (iii) a stack of plate, ring or wire loop electrodes.

72. A mass spectrometer as claimed in claim 16, wherein said ion guide comprises a plurality of electrodes, each electrode having an aperture through which ions are transmitted in use.

73. A mass spectrometer as claimed in claim 16, wherein each electrode has a substantially circular aperture.

74. A mass spectrometer as claimed in claim 16, wherein each electrode has a single aperture through which ions are transmitted in use.

75. A mass spectrometer as claimed in claim 72, wherein the diameter of the apertures of at least 50%, 60%, 70%, 80%, 90% or 95% of the electrodes forming said ion guide is selected from the group consisting of: (i) less than or equal to 10 mm; (ii) less than or equal to 9 mm; (iii) less than or equal to 8 mm; (iv) less than or equal to 7 mm; (v) less than or equal to 6 mm; (vi) less than or equal to 5 mm; (vii) less than or equal to 4 mm; (viii) less than or equal to 3 mm; (ix) less than or equal to 2 mm; and (x) less than or equal to 1 mm.

76. A mass spectrometer as claimed in claim 16, wherein at least 50%, 60%, 70%, 80%, 90% or 95% of the electrodes forming the ion guide have apertures which are substantially the same size or area.

77. A mass spectrometer as claimed in claim 16, wherein said ion guide comprises a segmented rod set.

78. A mass spectrometer as claimed in claim 16, wherein said ion guide consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; or (xv) more than 150 electrodes.

79. A mass spectrometer as claimed in claim 16, wherein the thickness of at least 50%, 60%, 70%, 80%, 90% or 95% of said electrodes is selected from the group consisting of: (i) less than or equal to 3 mm; (ii) less than or equal to 2.5 mm; (iii) less than or equal to 2.0 mm; (iv) less than or equal to 1.5 mm; (v) less than or equal to 1.0 mm; and (vi) less than or equal to 0.5 mm.

80. A mass spectrometer as claimed in claim 16, wherein said ion guide has a length selected from the group consisting of: (i) less than 5 cm; (ii) 5–10 cm; (iii) 10–15 cm; (iv) 15–20 cm; (v) 20–25 cm; (vi) 25–30 cm; and (vii) greater than 30 cm.

81. A mass spectrometer as claimed in claim 16, wherein at least 10%, 20%, 30%, 40%, 50%, 60%, 70%, 80%, 90% or 95% of said electrodes are connected to both a DC and an AC or RF voltage supply.

82. A mass spectrometer as claimed in claim 16, wherein axially adjacent electrodes are supplied with AC or RF voltages having a phase difference of 180°.

83. A mass spectrometer as claimed in claim 16, further comprising an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ("LDI") ion source; (vi) Inductively Coupled Plasma ("ICP") ion source; (vii) Electron Impact ("EI") ion source; (viii) Chemical Ionisation ("CI") ion source; (ix) a Fast Atom Bombardment ("FAB") ion source; and (x) a Liquid Secondary Ions Mass Spectrometry ("LSIMS") ion source.

84. A mass spectrometer as claimed in claim 16, further comprising a continuous ion source.

85. A mass spectrometer as claimed in claim 16, further comprising a pulsed ion source.

86. A mass spectrometer as claimed in claim 16, wherein a DC potential waveform is applied to said electrodes and wherein the velocity of said DC potential waveform becomes progressively slower.

87. A mass spectrometer as claimed in claim 86, wherein the ions in a pulse of ions emitted from the ion guide have substantially the same energy or similar energies.

88. A mass spectrometer as claimed in claim 86, wherein the ions from a plurality of pulses of ions emitted from the ion guide have substantially the same energy or similar energies.

89. A mass spectrometer as claimed in claim 16, further comprising a mass analyser for mass analysing the ions exiting the ion guide.

90. A mass spectrometer as claimed in claim 89, further comprising an acceleration region for accelerating the ions exiting the ion guide through a constant voltage difference prior to entering said mass analyser.

91. A mass spectrometer as claimed in claim 89, wherein said mass analyser comprises an orthogonal acceleration Time of Flight mass analyser.

92. A mass spectrometer as claimed in claim 91, wherein said orthogonal acceleration Time of Flight mass analyser further comprises an electrode, wherein in use said electrode is energised after a delay time after ions are released from said ion guide.

93. A mass spectrometer as claimed in claim 92, wherein said delay time is progressively increased, decreased or varied.

94. A mass spectrometer as claimed in claim 93, wherein said delay time is increased or decreased substantially linearly, in a regular manner or according to a predetermined manner.

95. A method of mass spectrometry comprising:

temporally or spatially dispersing a group of ions according to a physico-chemical property;

receiving at least some of the ions which have become dispersed according to said physico-chemical property in an ion guide comprising a plurality of electrodes;

generating or creating multiple trapping regions along at least a portion of the length of said ion guide wherein at least a first group of ions having a physico-chemical property within a first range are trapped within a first trapping region and a second group of ions having a physico-chemical property within a second different range are trapped within a second different trapping region; and translating said multiple trapping regions along at least a portion of the length of said ion guide.

96. A method of mass spectrometry comprising:

releasing a first group ions having mass to charge ratios within a first range from a mass to charge ratio selective ion trap;

receiving at least some of the ions of said first group in an ion guide comprising a plurality of electrodes;

providing a first trapping region within said ion guide so that at least some of the ions of said first group are trapped within said first trapping region;

releasing a second group ions having mass to charge ratios within a second range from said mass to charge ratio selective ion trap;

receiving at least some of the ions of said second group in said ion guide;

providing a second different trapping region within said ion guide so that at least some of the ions of said second group are trapped within said second trapping region; and translating at least said first and second trapping regions along at least a portion of the length of said ion guide.

97. A mass spectrometer comprising:

a pulsed ion source for emitting a pulse of ions;

a region wherein ions in a pulse become dispersed according to their mass to charge ratio; and an ion guide comprising a plurality of electrodes, wherein in use a plurality of trapping regions are generated or created along at least a portion of the length of said ion guide and wherein said ion guide is arranged to receive said ions which have become dispersed according to their mass to charge ratio so that at least 50%, 60%, 70%, 80%, 90% or 95% of the ions within a trapping region have substantially the same or similar mass to charge ratios.

98. A mass spectrometer as claimed in claim 97, wherein said plurality of trapping regions are translated along at least a portion of the length of said ion guide with a velocity which becomes progressively slower.

99. A mass spectrometer as claimed in claim 98, wherein in use bunches of ions emerge from said ion guide and wherein said mass spectrometer further comprises an orthogonal acceleration Time of Flight mass analyser comprising an electrode for injecting ions into a drift region, wherein said electrode is energised after a delay period after each bunch of ions is released from a trapping region in said ion guide and wherein the energisation of said electrode is synchronised with the arrival of each bunch of ions at said electrode and wherein said delay period is progressively increased.

100. A method of mass spectrometry comprising:

emitting a pulse of ions;

arranging for the ions in a pulse to become dispersed according to their mass to charge ratio;

providing an ion guide comprising a plurality of electrodes;

generating or creating a plurality of trapping regions along at least a portion of the length of said ion guide; and receiving within said ion guide said ions which have become dispersed according to their mass to charge ratio so that at least 50%, 60%, 70%, 80%, 90% or 95% of the ions within a trapping region have substantially the same or similar mass to charge ratios.

101. A method as claimed in claim 100, further comprising translating said plurality of trapping regions along at least a portion of the length of said ion guide with a velocity which becomes progressively slower.

102. A method as claimed in claim 101, further comprising:

arranging for bunches of ions to emerge from said ion guide;

providing an orthogonal acceleration Time of Flight mass analyser comprising an electrode for injecting ions into a drift region;

energising said electrode after a delay period after each bunch of ions is released from a trapping region in said ion guide and in a synchronised manner with the arrival of each bunch of ions at said electrode; and progressively increasing said delay period.

* * * * *